US009724841B2

(12) United States Patent
Engelfried et al.

(10) Patent No.: US 9,724,841 B2
(45) Date of Patent: Aug. 8, 2017

(54) TOOL COUPLING DEVICE

(71) Applicant: Robert Bosch GmbH, Stuttgart (DE)

(72) Inventors: Uwe Engelfried, Ostfildern (DE); Thomas Duerr, Asperg (DE); Jens Zieger, Altbach (DE); Petr Grulich, Kirchheim/Teck (DE)

(73) Assignee: Robert Bosch GmbH, Stuttgart (DE)

( * ) Notice: Subject to any disclaimer, the term of this patent is extended or adjusted under 35 U.S.C. 154(b) by 179 days.

(21) Appl. No.: 14/411,411

(22) PCT Filed: Jun. 10, 2013

(86) PCT No.: PCT/EP2013/061868

§ 371 (c)(1),
(2) Date: Dec. 26, 2014

(87) PCT Pub. No.: WO2014/001066

PCT Pub. Date: Jan. 3, 2014

(65) Prior Publication Data

US 2015/0158199 A1 Jun. 11, 2015

(30) Foreign Application Priority Data

Jun. 28, 2012 (DE) ..... 10 2012 211 094

(51) Int. Cl.
*B27B 17/14* (2006.01)
*B27B 17/02* (2006.01)

(52) U.S. Cl.
CPC ..... *B27B 17/14* (2013.01); *B27B 17/02* (2013.01)

(58) Field of Classification Search
CPC ..... B27B 17/02; B27B 17/14
USPC ..... 30/386
See application file for complete search history.

(56) References Cited

U.S. PATENT DOCUMENTS 3,267,973 A * 8/1966 Beard ..... B27B 17/14 30/386
4,316,327 A * 2/1982 Scott ..... B27B 17/14 30/386
6,237,228 B1 * 5/2001 Moody ..... B27B 17/14 30/381

(Continued)

FOREIGN PATENT DOCUMENTS

CN 1622871 A 6/2005
CN 201011381 Y 1/2008

(Continued)

OTHER PUBLICATIONS

International Search Report corresponding to PCT Application No. PCT/EP2013/061868, mailed Sep. 24, 2013 (German and English language document) (5 pages).

*Primary Examiner* — Hwei C Payer
(74) *Attorney, Agent, or Firm* — Maginot, Moore & Beck LLP

(57) ABSTRACT

A tool coupling device for a receptacle of a machine tool separating device formed as a closed system includes at least one cutting strand tensioning unit that has at least one tensioning element. The tool coupling device also includes at least one operating unit that includes at least one operating element. The cutting strand tensioning unit includes at least one gear unit that is configured to move the tensioning element as a result of an actuation of the operating element of the operating unit.

16 Claims, 14 Drawing Sheets

(56) References Cited

U.S. PATENT DOCUMENTS

| | | | | |
|---|---|---|---|---|
| 6,560,879 | B2 * | 5/2003 | Franke | B27B 17/14 30/383 |
| 6,694,623 | B1 * | 2/2004 | Haughey | B27B 17/14 30/386 |
| 7,107,689 | B2 * | 9/2006 | Keeton | B27B 17/14 30/383 |
| 7,743,513 | B1 * | 6/2010 | Fisher | B27B 17/14 30/383 |
| 9,132,568 | B2 * | 9/2015 | Peterson | B27B 17/14 |
| 2010/0088905 | A1 * | 4/2010 | Pellenc | B27B 17/14 30/386 |
| 2011/0314682 | A1 * | 12/2011 | Maag | B27B 17/14 30/386 |
| 2014/0150271 | A1 * | 6/2014 | Yamaoka | B27B 17/14 30/386 |
| 2015/0158199 | A1 * | 6/2015 | Engelfried | B27B 17/02 30/383 |
| 2015/0290830 | A1 * | 10/2015 | Zieger | B27B 17/02 30/383 |

FOREIGN PATENT DOCUMENTS

| | | | |
|---|---|---|---|
| CN | 101668619 | A | 3/2010 |
| DE | 197 46 891 | A1 | 4/1998 |
| EP | 1 764 197 | A2 | 3/2007 |
| WO | 2005108030 | A1 | 11/2005 |
| WO | 2010/105809 | A1 | 9/2010 |

* cited by examiner

TOOL COUPLING DEVICE

This application is a 35 U.S.C. §371 National Stage Application of PCT/EP2013/061868, filed on Jun. 10, 2013, which claims the benefit of priority to Ser. No. DE 10 2012 211 094.1, filed on Jun. 28, 2012 in Germany, the disclosures of which are incorporated herein by reference in their entirety.

BACKGROUND

There are already known tool coupling devices for receiving a power-tool parting device realized as a closed system, which has at least one cutting-strand tensioning unit that has at least one tensioning element, and which have at least one operating unit comprising at least one operating element.

SUMMARY

The disclosure is based on a tool coupling device, in particular a hand power-tool tool coupling device, for receiving a power-tool parting device realized as a closed system, having at least one cutting-strand tensioning unit that has at least one tensioning element, and having at least one operating unit comprising at least one operating element.

It is proposed that the cutting-strand tensioning unit comprise at least one transmission unit, which is provided to move the tensioning element as a result of an actuation of the operating element of the operating unit. The tensioning element is thus preferably connected to the operating element in a motionally dependent manner, via the transmission unit. "Provided" is to be understood to mean, in particular, specially programmed, designed and/or equipped. The tool coupling device is preferably provided to receive the power-tool parting device in a form-closed and/or force-closed manner, or to fix the power-tool parting device to a main body of the tool coupling device by means of a form-closed and/or by means of a force-closed connection. For the purpose of transmitting driving forces to the power-tool parting device, the power-tool parting device is preferably received by the tool coupling device, or fixed to the main body of the tool coupling device. Particularly preferably, the tool coupling device has at least one holding unit, which is provided to fix the power-tool parting device to the main body in at least one state. The holding unit preferably comprises at least one operating unit. The operating element in this case, at least in one state, preferably exerts a holding force upon the power-tool parting device, in particular in at least one state in which the power-tool parting device has been connected to the tool coupling device. The operating element preferably fixes the power-tool parting device to the main body of the tool coupling device by means of a form-closed and/or by means of a force-closed connection. It is also conceivable, however, for the holding unit to be of another design, considered appropriate by persons skilled in the art. Moreover, the holding unit preferably comprises at least one fixing unit, comprising at least one fixing element provided to fix the operating element in at least one position. Thus, for the purpose of receiving a power-tool parting device, realized as a closed system, the tool coupling device has at least the cutting-strand tensioning unit comprising at least the tensioning element, and has at least the holding unit comprising the operating unit, the cutting-strand tensioning unit comprising at least the transmission unit, which is provided to move the tensioning unit as a result of an actuation of the operating element of the holding unit comprising the operating unit.

The term "cutting-strand tensioning unit" is intended here to define, in particular, a unit provided to exert a tensioning force upon the cutting strand, for the purpose of tensioning, or pretensioning, a cutting strand of the power-tool parting device, at least in a state in which the power-tool parting device has been connected to the tool coupling device. The tensioning element in this case is preferably mounted on the main body of the tool coupling device so as to be movable relative to the main body of the tool coupling device. An "operating unit" is to be understood here to mean, in particular, a unit having at least the operating element, which can be actuated directly by an operator, and which is provided to influence and/or alter a process and/or a state of a unit coupled to the operating unit, through an actuation and/or through an input of parameters. The term "operating element" is intended to define, in particular, an element provided to pick up an input quantity from an operator in the case of an operating action, and in particular to be contacted directly by an operator, contacting of the operating element being sensed and/or an actuating force exerted upon the operating element being sensed and/or being transferred mechanically for the purpose of actuating a unit, in particular the transmission unit.

A "transmission unit" is to be understood here to mean, in particular, a mechanical mechanism by means of which at least one movement quantity of at least one component, such as, for example, a movement type (rotation, translation, etc.), a movement path, a movement speed and/or an acceleration can be altered. Preferably, the transmission unit is provided to step up and/or step down a force and/or a torque and/or to convert a movement type, such as, for example, conversion of a rotational movement of one component into a translational movement of another component. Particularly preferably, the transmission unit is provided for converting movement, or changing a movement type, between the operating element and the tensioning element. The transmission unit in this case may be realized as an eccentric mechanism, as a lever mechanism, as a cam mechanism, as a screw mechanism, etc. Advantageously, the design according to the disclosure makes it possible to achieve a tool coupling device that is easy to operate. Advantageously, by means of the cutting-strand tensioning unit, an automatic tensioning operation can be realized by actuation of the operating element.

Furthermore, it is proposed that the operating element be mounted such that it can be swiveled about an axis of motion of the operating element that is at least substantially parallel to a plane of main extent of the operating element. "Substantially parallel" is to be understood here to mean, in particular, an alignment of a direction relative to a reference direction, in particular in one plane, the direction deviating from the reference direction by, in particular, less than 8°, advantageously less than 5°, and particularly advantageously less than 2°. The term "plane of main extent" is intended here to define, in particular, a plane in which the operating element has a maximum extent. Preferably in this case, the operating element can be swiveled by a swivel angle that, in particular, is greater than 5°, preferably greater than 45°, and particularly preferably greater than 75°. Preferably, the plane of main extent of the operating element, in an operating element swiveled fully into an open position, is at least substantially parallel to a rotation axis of a drive element that is mounted in a rotatable manner in the main body of the tool coupling device. Preferably in this case, the axis of motion of the operating element is at least substantially perpendicular to a rotation axis of a drive element of the tool coupling device, or of a portable power tool comprising the tool coupling device, that is mounted in a rotatable manner in the main body of the tool coupling device. The expression "substantially perpendicular" is intended here to define, in particular, an alignment of a direction relative to a reference direction, wherein the direction and the relative direction, in particular as viewed in one plane, enclose an angle of 90° and the angle has a maximum deviation of, in particular, less than 8°, advantageously less than 5°, and particularly advantageously less than 2°. Advantageously, a lever principle may be used to generate a tensioning force. Thus, advantageously, the tool coupling device according to the disclosure can be made easy to operate, with only a small amount of force being required, advantageously, to move the operating element, or the tensioning element.

In an alternative design of the tool coupling device according to the disclosure, it is proposed that the operating element be mounted such that it can rotate about an axis of motion of the operating element that is at least substantially perpendicular to a plane of main extent of the operating element. Preferably, the plane of main extent of the operating element is at least substantially perpendicular to the rotation axis of the drive element. Advantageously, the design according to the disclosure makes it possible to achieve a compact tool coupling device.

It is additionally proposed that the tensioning element be mounted in a translationally movable manner. The expression "mounted in a translationally movable manner" is intended here to define, in particular, a mounting of a unit and/or of an element relative to at least one other unit and/or one other element, the unit and/or the element, in particular dissociated from an elastic deformation of the unit and/or element, and dissociated from movement capabilities caused by a bearing clearance, having a capability to move along at least one axis, along a distance greater than 1 mm, preferably greater than 5 mm, and particularly preferably greater than 10 mm. Advantageously, the design according to the disclosure makes it possible to achieve a compact tool coupling device.

It is additionally proposed that the transmission unit have at least one gate element for moving the tensioning element as a result of an actuation of the operating element. A "gate element" is to be understood here to mean, in particular, an element having at least one recess, in particular a slot, in which there engages a further element that corresponds to the element, and/or which has at least one extension that engages in a recess of a further element that corresponds to the element, a constrained movement of the further element being effected, in dependence on a geometric shape of the recess, as a result of a movement of the element. Preferably, the gate element is realized as a gate disk or as a gate translation element. Preferably, the tensioning element engages in the recess of the gate element. Through simple design means, it is possible to achieve movement of the tensioning element on a predefined movement path. Thus, advantageously, the travel distance along which the tensioning element moves can be limited through simple design means.

Furthermore, it is proposed that the gate element be mounted in a translationally movable manner. Preferably, the gate element has an axis of motion that is at least substantially perpendicular to the rotation axis of the drive element. Preferably, the gate element is guided translationally by two linear guide elements of the transmission unit that are at least substantially parallel to each other. Advantageously, the design of the tool coupling device according to the disclosure enables the gate element to be guided in a precise manner.

Moreover, in an alternative design of the tool coupling device, it is proposed that the gate element be mounted in a rotatable manner. Preferably, the gate element has an axis of motion that is at least substantially parallel to the rotation axis of the drive element. Advantageously, it is possible to achieve a transmission unit designed to have a flat structure. Thus, advantageously, a compact tool coupling device can be achieved.

It is additionally proposed that the cutting-strand tensioning unit have at least one spring element, which is provided to apply a spring force to the tensioning element and/or to a gate element of the transmission unit. A "spring element" is to be understood to mean, in particular, a macroscopic element having at least two ends that are spaced apart from each other and that, in a normal operating state, can be moved elastically relative to each other along a movement path, the movement path being at least greater than 0.5 mm, in particular greater than 1 mm, preferably greater than 2 mm, and particularly advantageously greater than 3 mm, and that, in particular, generates a counter-force, which is dependent on an elastic movement of the ends relative to each other and preferably proportional to the elastic movement of the ends relative to each other, and which counteracts the variation. A "macroscopic element" is to be understood to mean, in particular, an element having an extent of at least 1 mm, in particular of at least 5 mm, and preferably of at least 10 mm. The spring element in this case may be realized as a tension spring, as a compression spring, as a torsion spring, as a spiral spring, etc. Particularly preferably, the spring element is realized as a helical compression spring or as a leg spring. It is also conceivable, however, for the spring element to be of different design, considered appropriate by persons skilled in the art. Advantageously, the design of the tool coupling device according to the disclosure enables the tensioning element to be biased to at least one operating position, in particular to a tensioning position.

Furthermore, it is proposed that the transmission unit comprise at least one lever element that, as a result of an actuation of the operating element, moves a gate element of the transmission unit for the purpose of moving the tensioning element. A "lever element" is to be understood here to mean, in particular, an element mounted such that it can be swiveled at least about an axis of motion of the element and that, in particular, has a maximum extent along a direction that is at least substantially perpendicular to the axis of motion, in order to realize at least one lever arm. Preferably, the lever element is realized as a two-sided lever element that, as viewed in two opposing directions, out from the axis, or from a rotation point, realizes a load arm and a power arm, respectively. It is conceivable for the transmission unit to have a multiplicity of lever elements that act in combination with each other, or are connected to each other, for the purpose of moving the tensioning element. Advantageously, by means of the design according to the disclosure, a stepped-up force can be produced for the purpose of moving the tensioning element. Thus, advantageously, a small actuating force, applied by an operator to actuate the operating element, can be stepped up to a large actuating force of the tensioning element.

It is additionally proposed that the transmission unit have at least one eccentric element that acts in combination with the tensioning element for the purpose of moving the tensioning element as a result of an actuation of the operating element. An "eccentric element" is to be understood here to mean, in particular, an element mounted such that it can be swiveled at least about an axis of motion of the element, a mid-point, in particular a symmetry mid-point, of the element being disposed outside of the axis of motion. The eccentric element in this case may be directly or indirectly coupled to the tensioning element. Advantageously, a movement of the operating element can be converted to a movement of the tensioning element.

It is additionally proposed that the tool coupling device have at least one fixing unit, comprising at least one fixing element provided to fix the operating element in at least one position. Preferably, the fixing element is mounted in a rotatable manner. It is also conceivable, however, for the fixing element to be mounted in a translationally movable manner. Advantageously, by means of the design according to the disclosure, unintentional movement of the operating element can be prevented.

The disclosure is additionally based on a portable power tool comprising a tool coupling device according to the disclosure. The tool coupling device is preferably provided for form-closed and/or force-closed coupling to a power-tool parting device. A "portable power tool" is to be understood here to mean, in particular, a power tool, in particular a hand power tool, that can be transported by an operator without the use of a transport machine. The portable power tool has, in particular, a mass of less than 40 kg, preferably less than 10 kg, and particularly preferably less than 5 kg. Advantageously, it is possible to achieve a portable power tool on which a power-tool parting device can be arranged in a particularly convenient manner.

The disclosure is additionally based on a power tool system comprising a power tool according to the disclosure, and comprising a power-tool parting device, which has at least one cutting strand and has at least one guide unit that, together with the cutting strand, forms a closed system. A "cutting strand" is to be understood here to mean, in particular, a unit provided to locally undo an atomic coherence of a workpiece on which work is to be performed, in particular by means of a mechanical parting-off and/or by means of a mechanical removal of material particles of the workpiece. Preferably, the cutting strand is provided to separate the workpiece into at least two parts that are physically separate from each other, and/or to part off and/or remove, at least partially, material particles of the workpiece, starting from a surface of the workpiece. The cutting strand is preferably realized as a cutting chain. It is also conceivable, however, for the cutting strand to be of another design, considered appropriate by persons skilled in the art, such as, for example, designed as a cutting cord, to which cutting elements are fixed. The expression "guide unit" is intended here to define, in particular, a unit provided to exert a constraining force upon the cutting strand, at least along a direction perpendicular to a cutting direction of the cutting strand, in order to define a movement capability of the cutting strand along the cutting direction. A "cutting direction" is to be understood here to mean, in particular, a direction along which the cutting strand is moved, in at least one operating state, as a result of a driving force and/or a driving torque, in particular in the guide unit, for the purpose of producing a cut and/or parting-off and/or removing material particles of a workpiece on which work is to be performed. Preferably, the cutting strand, when in an operating state, is moved, relative to the guide unit, along the cutting direction. The term "closed system" is intended here to define, in particular, a system comprising at least two components that, by means of combined action, when the system has been demounted from a system, in particular the tool coupling device, that is of a higher order than the system, maintain a functionality and/or are inseparably connected to each other when in the demounted state. Preferably, the at least two components of the closed system are connected to each other so as to be at least substantially inseparable by an operator. "At least substantially inseparable" is to be understood here to mean, in particular, a connection of at least two components that can be separated from each other only with the aid of parting tools such as, for example, a saw, in particular a mechanical saw, etc. and/or chemical parting means such as, for example, solvents, etc.

In particular, the power-tool parting device, as viewed along a direction that is at least substantially perpendicular to a cutting plane of the power-tool parting device, has a maximum dimension of less than 10 mm, preferably less than 8 mm, and particularly preferably less than 5 mm. Preferably, the dimension is realized as the width of the power-tool parting device. Particularly preferably, the power-tool parting device, as viewed along the direction that is at least substantially perpendicular to the cutting plane of the power-tool parting device, has a maximum dimension that is at least substantially constant along a total length of the power-tool parting device. The power-tool parting device is thus preferably provided to produce a cut that has a maximum dimension of less than 5 mm, as viewed along the direction that is at least substantially perpendicular to the cutting plane of the power-tool parting device. The design according to the disclosure makes it possible, advantageously, to achieve a power tool system that can be adapted in a particularly convenient manner to differing fields of application in that, advantageously, the power-tool parting device can be removed from the tool coupling device.

The tool coupling device according to the disclosure, the portable power tool according to the disclosure and/or the power tool system according to the disclosure is/are not intended in this case to be limited to the application and embodiment described above. In particular, the tool coupling device according to the disclosure, the portable power tool according to the disclosure and/or the power tool system according to the disclosure may have individual elements, components and units that differ in number from the number stated herein, in order to fulfill a principle of function described herein.

BRIEF DESCRIPTION OF THE DRAWINGS

Further advantages are given by the following description of the drawings. The drawings show exemplary embodiments of the disclosure. The drawings, the description and the claims contain numerous features in combination. Persons skilled in the art will also expediently consider the features individually and combine them to create appropriate further combinations.

There are shown in the drawings.

DETAILED DESCRIPTION

Figure 1:
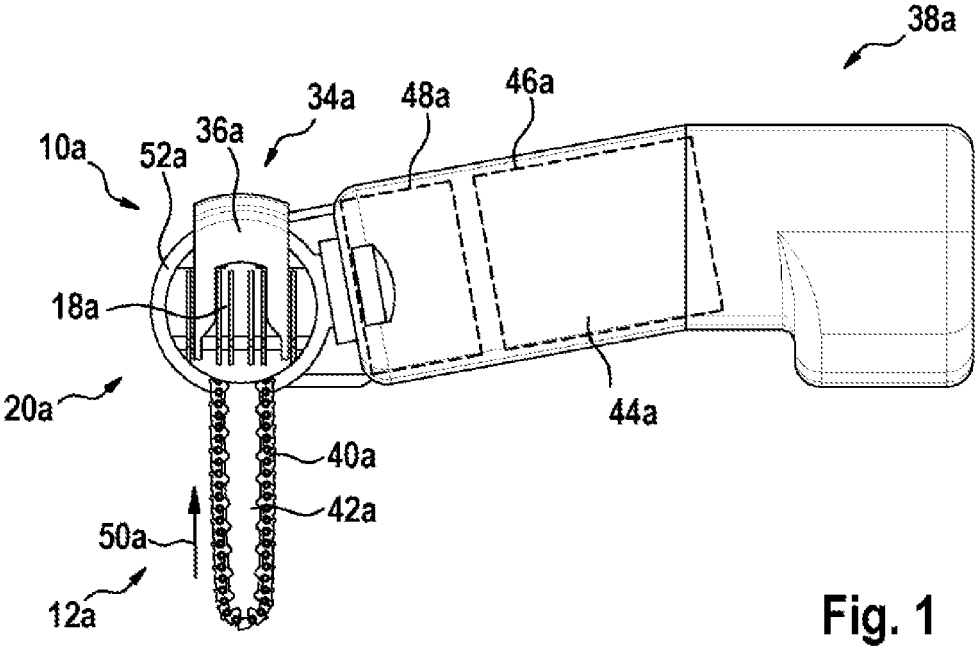
FIG. 1 a portable power tool according to the disclosure, having a tool coupling device according to the disclosure, in a schematic representation, FIG. 2 a detail view of the tool coupling device according to the disclosure, in a schematic representation, FIG. 3 a sectional view of the tool coupling device according to the disclosure, in a schematic representation, FIG. 4 a detail view of a carrier element of a cutting-strand tensioning unit of the tool coupling device according to the disclosure, in a schematic representation, FIG. 5 a side view of the tool coupling device according to the disclosure, with a power-tool parting device disposed in the tool coupling device according to the disclosure, in a schematic representation, FIG. 6 a further side view of the tool coupling device according to the disclosure, with the power-tool parting device disposed in the tool coupling device according to the disclosure, in a schematic representation, FIG. 7 a detail view of an alternative tool coupling device according to the disclosure, in a schematic representation, FIG. 8 a sectional view of the alternative tool coupling device according to the disclosure, in a schematic representation, FIG. 9 an exploded view of the alternative tool coupling device according to the disclosure, in a schematic representation, FIG. 10 a detail view of a further, alternative tool coupling device according to the disclosure, in a schematic representation, FIG. 11 a further detail view of the further, alternative tool coupling device according to the disclosure, in a schematic representation, FIG. 12 a sectional view of the further, alternative tool coupling device according to the disclosure, in a schematic representation, FIG. 13 a detail view of a further, alternative tool coupling device according to the disclosure, in a schematic representation, FIG. 14 a sectional view of the further, alternative tool coupling device according to the disclosure from FIG. 13, in a schematic representation, FIG. 15 a detail view of a further, alternative tool coupling device according to the disclosure, in a schematic representation, FIG. 16 a further detail view of the further, alternative tool coupling device according to the disclosure from FIG. 15, in a schematic representation, FIG. 17 a detail view of a further, alternative tool coupling device according to the disclosure, in a schematic representation, FIG. 18 a further detail view of the further, alternative tool coupling device according to the disclosure from FIG. 17, in a schematic representation, FIG. 19 a detail view of a further, alternative tool coupling device according to the disclosure, in a schematic representation, FIG. 20 a further detail view of the further, alternative tool coupling device according to the disclosure from FIG. 19, in a schematic representation, FIG. 21 a sectional view of the further, alternative tool coupling device according to the disclosure from FIG. 19, in a schematic representation, FIG. 22 a detail view of an alternative design of a power-tool parting-device hold-down unit, in a schematic representation, FIG. 23 a detail view of a further, alternative design of a power-tool parting-device hold-down unit, in a schematic representation, FIG. 24 a detail view of a further, alternative design of a power-tool parting-device hold-down unit, in a schematic representation, FIG. 25 a detail view of a further, alternative design of a power-tool parting-device hold-down unit, in a schematic representation, FIG. 26 a detail view of a further, alternative design of a power-tool parting-device hold-down unit, in a schematic representation, FIG. 27 a detail view of a further, alternative design of a power-tool parting-device hold-down unit, in a schematic representation, FIG. 28 a detail view of a further, alternative design of a power-tool parting-device hold-down unit, in a schematic representation, FIG. 29 a detail view of a further, alternative design of a power-tool parting-device hold-down unit, in a schematic representation, FIG. 30 a detail view of a further, alternative design of a power-tool parting-device hold-down unit, in a schematic representation, FIG. 31 a detail view of a further, alternative design of a power-tool parting-device hold-down unit, in a schematic representation, FIG. 32 a detail view of an alternative design of a power-tool parting-device torque holding unit, in a schematic representation, FIG. 33 a detail view of a further, alternative design of a power-tool parting-device torque holding unit, in a schematic representation, FIG. 34 a detail view of a further, alternative design of a power-tool parting-device torque holding unit, in a schematic representation, and FIG. 35 a detail view of a further, alternative design of a power-tool parting-device torque holding unit, in a schematic representation.

FIG. 1 shows a portable power tool 38*a*, having a power-tool parting device 12*a* disposed on a tool coupling device 10*a* of the portable power tool 38*a*. The portable power tool 38*a* and the power-tool parting device 12*a* together form a power tool system. The power-tool parting device 12*a* comprises at least one cutting strand 40*a*, and at least one guide unit 42*a* for guiding the cutting strand 40*a*. The guide unit 42*a* and the cutting strand 40*a* together form a closed system. The power-tool parting device 12*a* is thus realized as a closed system. The portable power tool 38*a* has the tool coupling device 10*a* for coupling the power-tool parting device 12*a* in a form-closed and/or force-closed manner. The tool coupling device 10*a* is provided to receive the power-tool parting device 12*a* realized as a closed system. The tool coupling device 10*a* in this case comprises at least one cutting-strand tensioning unit 14*a*, which has at least one tensioning element 16*a*, and which has at least one operating unit 20*a* comprising at least one operating element 18*a*. Moreover, the portable power tool 38*a* has a power-tool housing 44*a*, which encloses a drive unit 46*a* and an output transmission unit 48*a* of the portable power tool 38*a*. The drive unit 46*a* and the output transmission unit 48*a* are operatively connected to each other, in a manner already known to persons skilled in the art, for the purpose of generating a drive torque that can be transmitted to the power-tool parting device 12*a*. The output transmission unit 48*a* is realized as a bevel gear transmission. The drive unit 46*a* is realized as an electric motor unit. It is also conceivable, however, for the drive unit 46*a* and/or the output transmission unit 48*a* to be of a different design, considered appropriate by persons skilled in the art, such as, for example, the drive unit 46*a* being designed as a hybrid drive unit or as an internal combustion drive unit, etc., and/or the output transmission unit 48*a* being designed as a worm gear transmission, etc. The drive unit 46*a* is provided to drive the cutting strand 40*a* of the power-tool parting device 12*a*, in at least one operating state, via the output transmission unit 48*a*. The cutting strand 40*a* in this case is moved in the guide unit 42*a* of the power-tool parting device 12*a*, along a cutting direction 50*a* of the cutting strand 40*a*, relative to the guide unit 42*a*.

Figure 2:
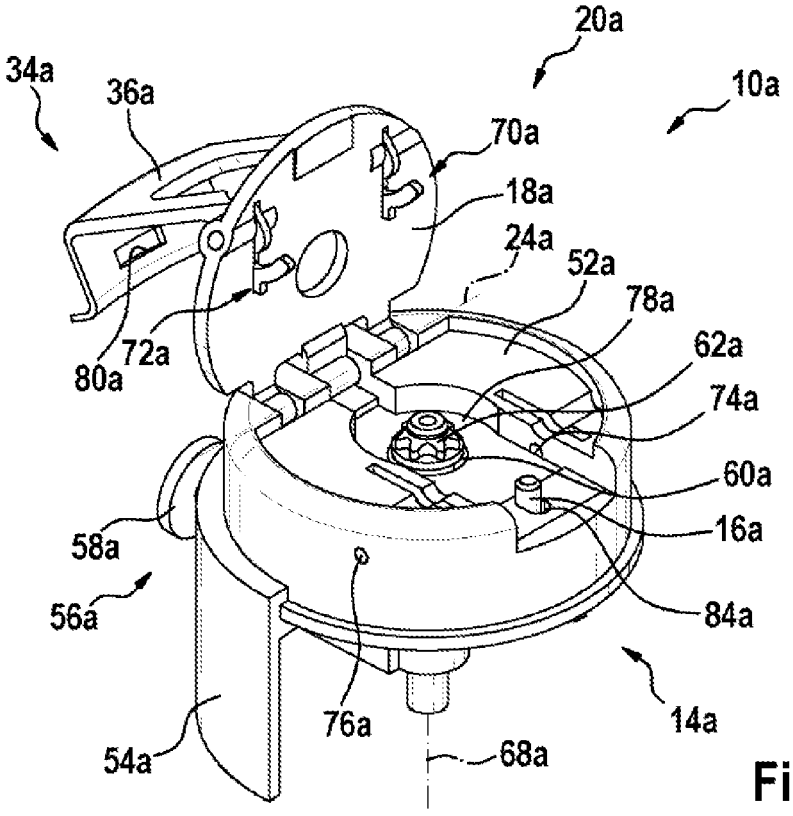

FIG. 2 shows the tool coupling device 10*a* demounted from the portable power tool 38*a*. The tool coupling device 10*a* comprises a main body 52*a*, which is mounted in a rotatable manner in a connection housing 54*a* of the tool coupling device 10*a*. The main body 52*a* in this case is mounted in the connection housing 54*a* so as to be rotatable about a rotation axis 68*a* of a drive element 62*a* of the tool coupling device 10*a*. When the tool coupling device 10*a* is mounted on the portable power tool 38*a*, the connection housing 54*a* is fixed to the power-tool housing 44*a* of the portable power tool 38*a*. The tool coupling device 10*a* has at least one rotary positioning unit 56*a*, for fixing a rotary position of the main body 52*a* relative to the connection housing 54*a*. The rotary positioning unit 56*a* in this case comprises at least one positioning element 58*a*, for fixing the main body 52*a* in a position relative to the connection housing 54*a*. The positioning element 58*a* in this case is realized as a spring-biased locking pin, which acts in combination with positioning recesses (not represented in greater detail here) of the main body 52*a*, in a manner already known to persons skilled in the art. It is also conceivable, however, for the rotary positioning unit 56*a* to be of a different design, considered appropriate by persons skilled in the art, such as, for example, designed as tooth system.

The main body 52*a* additionally has a rotary play opening 60*a* (FIG. 3), in which the drive element 62*a* of the tool coupling device 10*a* is disposed. In this case, the drive element 62*a*, as viewed along a direction that is at least substantially perpendicular to the rotation axis 68*a* of the drive element 62*a*, is disposed, relative to the main body 52*a*, at a distance from an edge region of the main body 52*a* that delimits the rotary play opening 60*a*. The drive element 62*a* is realized as a driving toothed wheel. The connection housing 54*a* comprises a bearing recess 64*a*, in which there is disposed a bearing element 66*a* of the tool coupling device 10*a*, for rotatably mounting the drive element 62*a*. The bearing element 66*a* is realized as a bearing sleeve. It is also conceivable, however, for the bearing element 66*a* to be realized as a rolling bearing. The drive element 62*a* is provided to transmit a driving force of the drive unit 46*a* to the cutting strand 40*a*. Thus, when the power-tool parting device 12*a* is connected to the tool coupling device 10*a*, the drive element 62*a* engages in the cutting strand 40*a*. In addition, when the tool coupling device 10*a* is mounted on the portable power tool 38*a*, the drive element 62*a* is connected to an output element (not represented in greater detail here) of the output transmission unit 48*a* in a rotationally fixed manner.

Furthermore, the operating element 18*a* of the operating unit 20*a* of the tool coupling device 10*a* is mounted such that it can swivel about an axis of motion 24*a* of the operating element 18*a* that is at least substantially parallel to a plane of main extent of the operating element 18*a*. The operating element 18*a* in this case is mounted in a swiveling manner on the main body 52*a*. The axis of motion 24*a* of the operating element 18*a*, as viewed in a plane of projection into which the axis of motion 24*a* and the rotation axis 68*a* of the drive element 62*a* are projected, is at least substantially perpendicular to the rotation axis 68*a*. The operating element 18*a* is mounted such that it can swivel by 90° relative to the main body 52*a*. It is also conceivable, however, for the operating element 18*a* to be mounted such that it can swivel by an angle other than 90° relative to the main body 52*a*.

Figure 5:
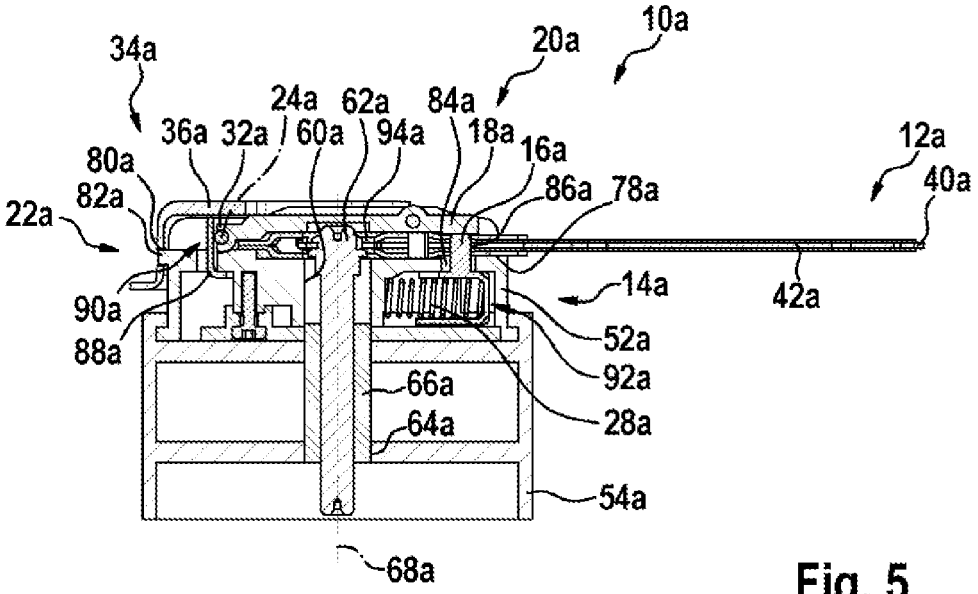
Figure 6:
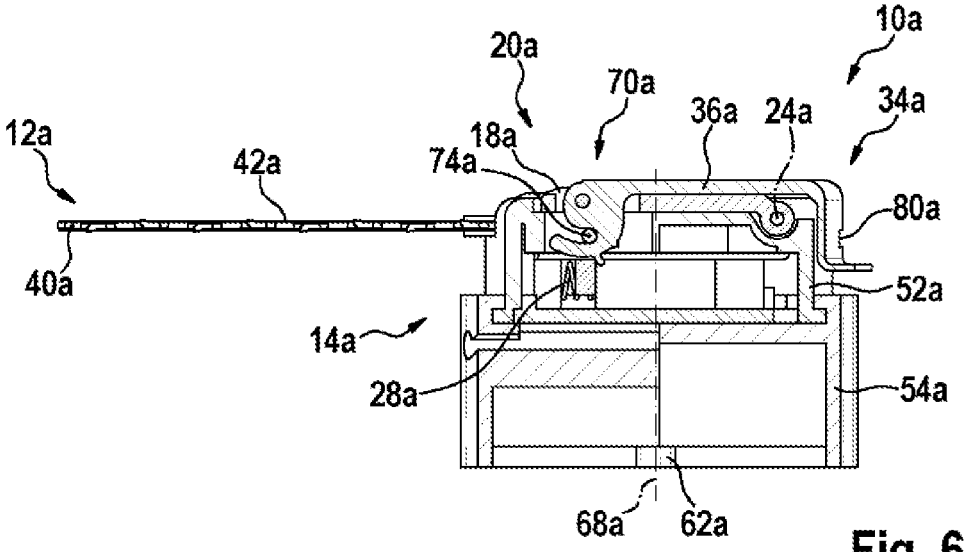

The tool coupling device 10*a* additionally has at least one fixing unit 34*a*, comprising at least one fixing element 36*a* provided to fix the operating element 18*a* in at least one position. The fixing element 36*a* is provided to fix the operating element 18*a* in a tool fixing position of the operating element 18*a*. For this purpose, the fixing element 36*a* is mounted in a swiveling manner. The fixing element 36*a* in this case is mounted in a swiveling manner on the operating element 18*a*. The fixing element 36*a* comprises at least two latching regions 70*a*, 72*a*. It is also conceivable, however, for the fixing element 36*a* to have a number of latching regions 70*a*, 72*a* other than two. The latching regions 70*a*, 72*a*, as viewed in a plane that is at least substantially perpendicular to the plane of main extent of the operating element 18*a*, or as viewed in a plane that is at least substantially parallel to the rotation axis 68*a* of the drive element 62*a*, are arcuate in form and each delimit an arcuate latching recess. Moreover, in an operating-element fixing position, the latching regions 70*a*, 72*a* act in combination with fixing studs 74*a*, 76*a* of the fixing unit 34*a* (FIG. 6). The fixing studs 74*a*, 76*a* are fixed to the main body 52*a*. The fixing unit 34*a* is thus provided to fix the operating element 18*a* in the tool fixing position by means of a form-closed connection. For the purpose of securing the fixing element 36*a* in the operating-element fixing position, the fixing element 36*a* additionally has a securing recess 80*a*, which acts in combination with a latching extension 82*a* of the fixing unit 34*a* when the fixing element 36*a* is in the operating-element fixing position (FIG. 5). The latching extension 82*a* in this case is integrally formed onto the main body 52*a*. It is also conceivable, however, for the latching extension 82*a* to be realized such that it is separate from the main body 52*a*, and to be fastened to the main body 52*a* by means of a fastening element considered appropriate by persons skilled in the art.

When the power-tool parting device 12*a* is coupled to the tool coupling device 10*a*, the power-tool parting device 12*a*, in the tool fixing position, is subjected to a clamping force in the direction of the main body 52*a* by means of the operating element 18*a*, in a receiving recess 78*a* of the main body 52*a*. This clamping force is generated by means of a swivel movement of the operating element 18*a* in the direction of the receiving recess 78*a* and by means of a combined action of the fixing element 36*a* and the fixing studs 74*a*, 76*a* when the operating element 18*a* is in the tool fixing position. Thus, at least the operating unit 20*a* and the fixing unit 34*a*, by acting in combination with the main body 52*a*, constitute a holding unit of the tool coupling device 10*a*. The holding unit is provided to act upon the power-tool parting device 12*a*, when the power-tool parting device 12*a* is coupled to the tool coupling device 10*a*, in a direction that is at least substantially parallel to the rotation axis 68*a* of the drive element 62*a*. It is also conceivable, however, for the holding unit to be of a different design, considered appropriate by persons skilled in the art (FIGS. 22 to 31).

Moreover, when the power-tool parting device 12*a* is coupled to the tool coupling device 10*a*, the power-tool parting device 12*a* is secured in a form-closed manner, by means of the receiving recess 78*a* of the main body 52*a*, against a rotational movement along a direction of rotation about the rotation axis 68*a* of the drive element 62*a*. The receiving recess 78*a* thus constitutes at least one power-tool parting-device torque holding element of a power-tool parting-device torque holding unit. For this purpose, the receiving recess 78*a* has a shape that corresponds to an external shape of at least one partial region of the power-tool parting device 12*a*, in particular a partial region of the guide unit 42*a*. The receiving recess 78*a* is thus realized as a negative shape of at least one partial region of the power-tool parting device 12*a*, in particular a partial region of the guide unit 42*a*. It is also conceivable, however, for the main body 52*a* to be of another design, considered appropriate by persons skilled in the art, that can prevent, insofar as possible, a rotational movement of the power-tool parting device 12*a* when the power-tool parting device 12*a* is coupled to the tool coupling device 10*a* (FIGS. 32 to 35).

Figure 3:
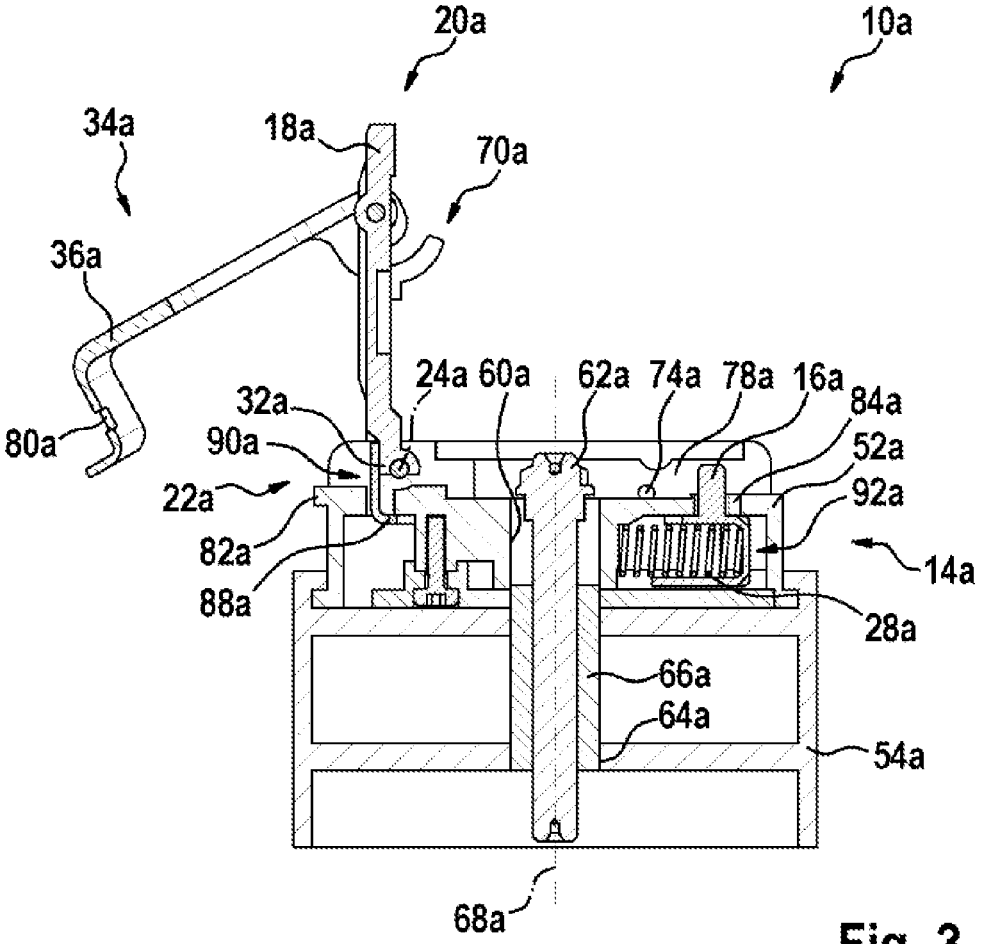

Furthermore, the cutting-strand tensioning unit 14*a* comprises at least one transmission unit 22*a*, which is provided to move the tensioning element 16*a* as a result of an actuation of the operating element 18*a* of the operating unit 20*a*. The tensioning element 16*a* in this case is mounted in a translationally movable manner in a guide recess 84*a* of the main body 52*a*. The guide recess 84*a* is disposed in the receiving recess 78*a*. The tensioning element 16*a* is realized as a tensioning stud, which engages in a tensioning recess 86*a* (FIG. 5) of the power-tool parting device 12*a* when the power-tool parting device 12*a* is coupled to the tool coupling device 10*a*. The tensioning element 16*a* is realized so as to be integral with a carrier element 88*a* of the cutting-strand tensioning unit 14*a*. The carrier element 88*a* is mounted in a translationally movable manner in the main body 52*a*. In addition, the carrier element 88*a* comprises an actuating region 90*a*, which acts in combination with a transmission element of the transmission unit 22*a* for the purpose of moving the tensioning element 16*a* as a result of an actuation of the operating element 18*a*. The transmission element of the transmission unit 22*a* in this case is realized as an eccentric element 32*a* (FIG. 3). The transmission unit 22*a* thus comprises at least the eccentric element 32*a*, which acts in combination with the tensioning element 16*a* for the purpose of moving the tensioning element 16*a* as a result of an actuation of the operating element 18*a*, via the carrier element 88*a*. The eccentric element 32*a* is realized so as to be integral with the operating element 18*a* (FIG. 3). The eccentric element 32*a* is disposed on the operating element 18*a*, eccentrically, or asymmetrically, in relation to the axis of motion 24*a* of the operating element 18*a*.

Figure 4:
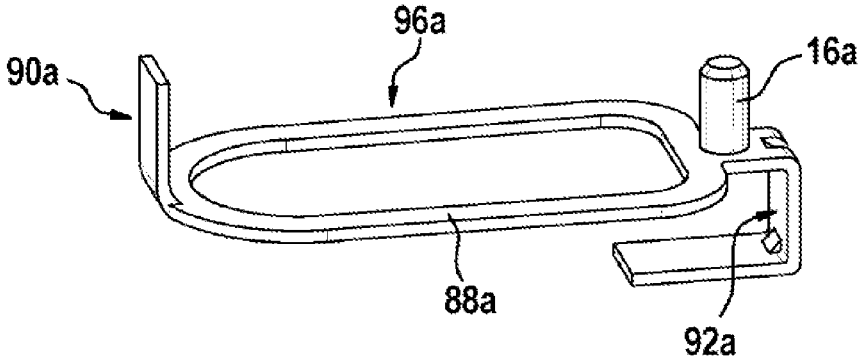

Moreover, the cutting-strand tensioning unit 14*a* has at least one spring element 28*a*, which is provided to apply a spring force to the tensioning element 16*a*. The spring element 28*a* in this case is supported with one end on the main body 52*a* and, with another end, the spring element 28*a* is supported on a tensioning force support region 92*a* of the carrier element 88*a*. It is additionally conceivable that, for the purpose of supporting a tensioning force of the tensioning element 16*a*, the carrier element 88*a* an additional clamping and/or locking of the carrier element 88*a* on the main body 52*a* is possible, such as, for example, by a rough surface of the carrier element 88*a* or by a carrier element locking unit, etc. The tensioning force support region 92*a* and the actuating region 90*a* of the carrier element 88*a* in this case are connected to each other via a connecting region 96*a* of the carrier element 88*a*. The connecting region 96*a* has an elliptical shape (FIG. 4). When the operating element 18*a* is in a position in which it has been swiveled away from the main body 52*a*, the spring element 28*a* is compressed as a result of a combined action of the eccentric element 32*a* and the actuating region 90*a* of the carrier element 88*a*. As a result, the tensioning element 16*a* is moved into a guide-unit insertion position.

For the purpose of coupling the power-tool parting device 12*a* to the tool coupling device 10*a*, the power-tool parting device 12*a* is inserted in the receiving recess 78*a* of the main body 52*a*, along a direction that is at least substantially parallel to the rotation axis 68*a* of the drive element 62*a*. The operating element 18*a* in this case is disposed in the position in which it has been swiveled away from the main body 52*a*. As the power-tool parting device 12*a* is inserted in the receiving recess 78*a*, the drive element 62*a* is introduced into a coupling recess 94*a* of the guide unit 42*a* (FIG. 5). As a result, the cutting strand 40*a* engages with the drive element 62*a*. In addition, the tensioning element 16*a* is introduced into the tensioning recess 86*a* of the guide unit 42*a*. As a result of the operating element 18*a* being moved into the tool fixing position, the eccentric element 32*a* releases the actuating region 90*a* of the carrier element 88*a*. The carrier element 88*a*, together with the tensioning element 16*a*, is thus moved by a spring force of the spring element 28*a*, translationally in a direction away from the drive element 62*a*, into a tensioning position of the tensioning element 16*a*. As a result, the guide unit 42*a* is moved relative to the drive element 62*a*. This causes the cutting strand 40*a* to be tensioned by the spring force of the spring element 28*a*, or by the movement of the tensioning element 16*a*. Thus, automatic tensioning of the cutting strand 40*a* is effected as a result of the power-tool parting device 12*a* being clamped in the receiving recess 78*a* of the main body 52*a*. Moreover, the fixing of the operating element 18*a* by means of the fixing unit 34*a* results in self-locking of the cutting-strand tensioning unit 14*a*, in order to avoid unwanted removal of a tensioning force for tensioning the cutting strand 40*a*.

Alternative exemplary embodiments are represented in FIGS. 7 to 35. Components, features and functions that remain substantially the same are denoted basically by the same references. To differentiate the exemplary embodiments, the letters a to g, or superscript numerals, have been appended to the references of the exemplary embodiments. The following description is limited substantially to the differences as compared with the first exemplary embodiment described in FIGS. 1 to 6, and reference may be made to the description of the first exemplary embodiment in FIGS. 1 to 6 in respect of components, features and functions that remain the same.

Figure 7:
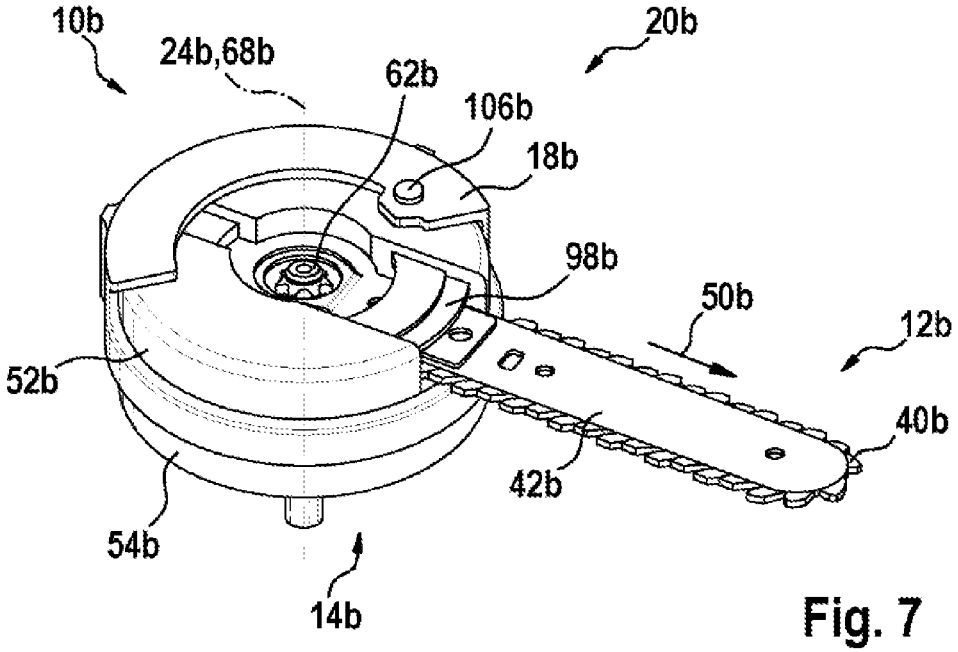

FIG. 7 shows an alternative tool coupling device 10*b*, which is provided to receive a power-tool parting device 12*b* realized as a closed system, demounted from a portable power tool (not represented in greater detail here). The portable power tool is of a design similar to that of the portable power tool 38*a* described in FIGS. 1 to 6. The portable power tool and the power-tool parting device 12*b* together form a power tool system. The tool coupling device 10*b* has at least one cutting-strand tensioning unit 14*b*, which comprises at least one tensioning element 16*b*, and at least one operating unit 20*b* that comprises at least one operating element 18*b*. The operating element 18*b* in this case is mounted so as to be rotatable about an axis of motion 24*b* of the operating element 18*b* that is at least substantially perpendicular to a plane of main extent of the operating element 18*b*, or about one that is at least substantially parallel to a rotation axis 68*b* of a drive element 62*b* of the tool coupling device 10*b*. Moreover, the operating unit 20*b* comprises at least one clamping element 98*b*, which is provided to apply a clamping force to the power-tool parting device 12*b*, in the direction of a main body 52*b* of the tool coupling device 10*b*, when the operating element 18*b* is in a tool fixing position. The clamping element 98*b* is realized in the form of a circular-ring segment. In addition, the clamping element 98*b* is mounted in a rotatable manner in the main body 52*b*. For the purpose of generating a clamping force, the clamping element 98*b* has a tensioning region 100*b* in the shape of a spiral, or in the shape of a screw thread. The tensioning region 100*b* is disposed on an outer circumference of the clamping element 98*b*. It is also conceivable, however, for the tensioning region 100*b* to be disposed at another position on the clamping element 98*b*, considered appropriate by persons skilled in the art, such as, for example, on an inner circumference of the clamping element 98*b*. The tensioning region 100*b* has a slope, as viewed along a circumferential direction extending around the rotation axis 68*b* of the drive element 62*b*. Along a total extent of the tensioning region 100*b*, therefore, the tensioning region 100*b* is sloped relative to a plane of main extent of the clamping element 98*b*. The tensioning region 100*b*, for the purpose of generating a clamping force, acts in combination with a tensioning slot (not represented in greater detail here) of the main body 52*b*, in which the tensioning region 100*b* engages.

Figure 9:
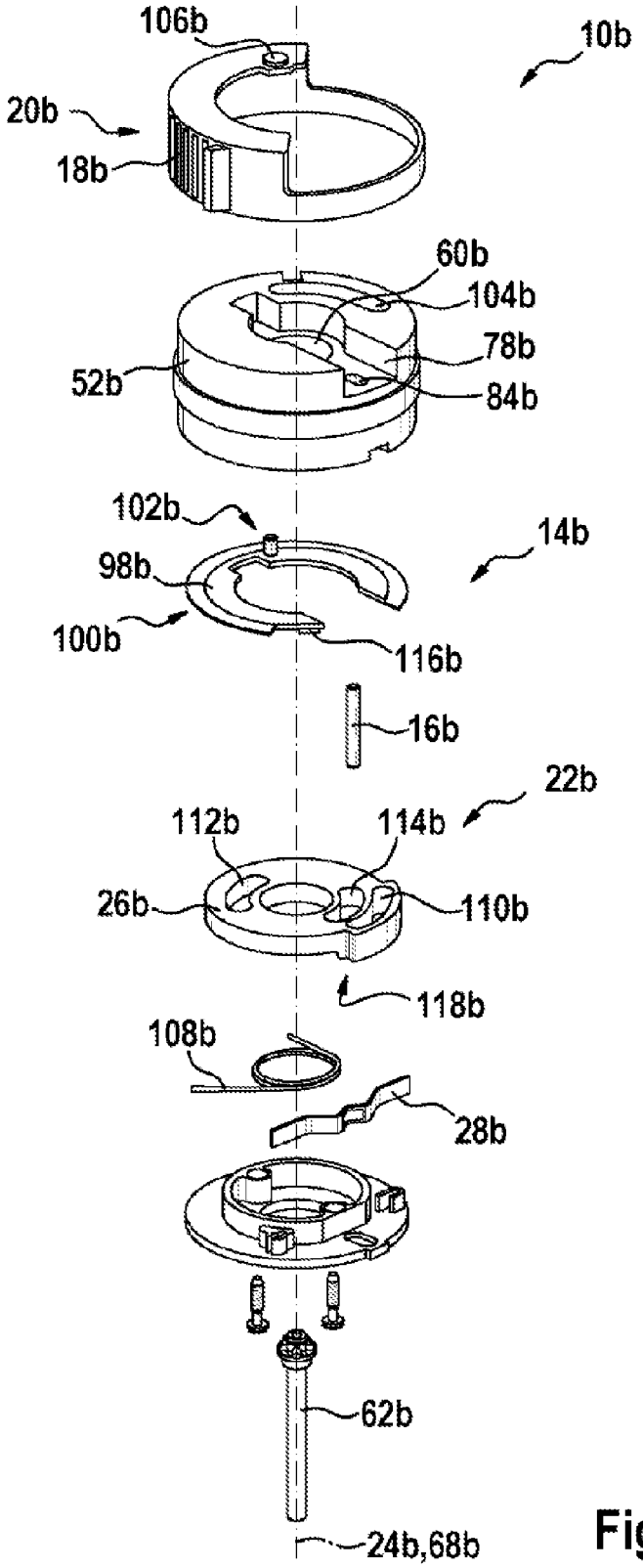

For the purpose of moving the clamping element 98*b* as a result of an actuation of the operating element 18*b*, in particular as a result of a rotation of the operating element 18*b*, the clamping element 98*b* comprises a stud-type actuating region 102*b* (FIG. 9). When the clamping element 98*b* is in a mounted state, the actuating region 102*b* is disposed in a movement guide recess 104*b* of the main body 52*b*, which movement guide recess is in the shape of a circular-ring segment (FIG. 9). The operating element 18*b* has a movement transmission element 106*b*, which is provided to receive the actuating region 102*b* of the clamping element 98*b*. The movement transmission element 106*b* is realized as a cup-shaped hollow, which is realized so as to correspond to the stud-type actuating region 102*b* of the clamping element 98*b*. It is also conceivable, however, for the movement transmission element 106*b* to be of another design, considered appropriate by persons skilled in the art, such as, for example, designed as a circular through-hole, etc.

Figure 8:
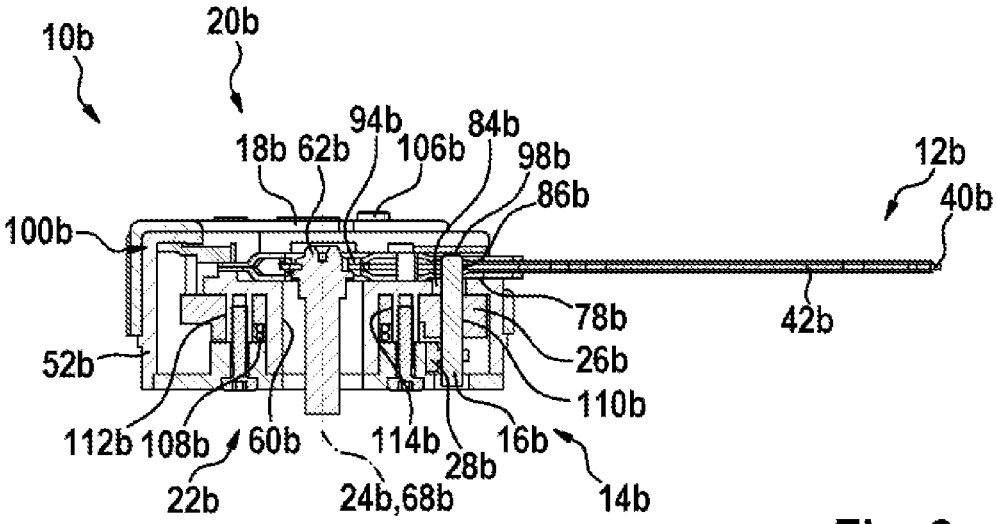

Furthermore, the cutting-strand tensioning unit 14*b* comprises at least one transmission unit 22*b*, which is provided to move the tensioning element 16*b* as a result of an actuation of the operating element 18*b* of the operating unit 20*b*. The tensioning element 16*b* in this case is mounted in a translationally movable manner in a guide recess 84*b* of the main body 52*b* of the tool coupling device 10*b*. The transmission unit 22*b* has at least one gate element 26*b* for moving the tensioning element 16*b* as a result of an actuation of the operating element 18*b*. The gate element 26*b* in this case is mounted in a rotatable manner. Moreover, the gate element 26*b* is realized as a gate disk, which has at least one tensioning-element guide gate 110*b* and at least two gate-element guide recesses 112*b*, 114*b* (FIG. 9). In this case, the tensioning element 16*b*, when in a mounted state, is disposed in the tensioning-element guide gate 110*b*. The tensioning-element guide gate 110*b* in this case has a spiral course in relation to the rotation axis 68*b* of the drive element 62*b*. In addition, the cutting-strand tensioning unit 14*b* comprises at least one spring element 28*b*, which is provided to apply a spring force to the tensioning element 16*b* (FIGS. 8 and 9). The spring element 28*b* is realized as a spring plate, which applies a spring force to the tensioning element 16*b* in the direction of a tensioning position of the tensioning element 16*b*. The cutting-strand tensioning unit 14*b* additionally comprises at least one further spring element 108*b*, which is provided to apply a spring force to the gate element 26*b* of the transmission unit 22*b* (FIGS. 8 and 9). The further spring element 108*b* is realized as a leg spring. The further spring element 108*b* in this case is supported with one end on the main body 52*b* and, with another end, the further spring element 108*b* is supported on the gate element 26*b*.

The gate element 26*b* is moved against the spring force of the further spring element 108*b* by means of the clamping element 98*b*, or by means of a rotational movement of the operating element 18*b*, via the clamping element 98*b*. For this purpose, the clamping element 98*b* has a driving extension 116*b*, which extends in the direction of the gate element 26*b*. The driving extension 116*b* acts in combination with a movement driving region 118*b* of the gate element 26*b* for the purpose of moving the gate element 26*b* (FIG. 9). As a result, the gate element 26*b* is moved, at least in one direction, in dependence on a movement of the clamping element 98*b*. A movement of the gate element 26*b* causes the tensioning element 16*b* to be moved, by means of the tensioning-element guide gate 110*b*, into a guide-unit insertion position. In addition, the clamping element 98*b* releases a receiving recess 78*b* of the main body 52*b*, for the purpose of receiving the power-tool parting device 12*b*. The guide recess 84*b*, in which the tensioning element 16*b* is guided, is disposed in the region of the receiving recess 78*b* on the main body 52*b*.

After the receiving recess 78*b* has been released and the clamping element 16*b* has moved into the guide-unit insertion position, the power-tool parting device 12*b* can be introduced into the receiving recess 78*b*, along a direction that is at least substantially parallel to the rotation axis 68*b* of the drive element 62*b*. A rotational movement of the operating element 18*b* then causes the clamping element 98*b* to be moved into a clamping position, causing a clamping force to be exerted upon the power-tool parting device 12*b* in the direction of the main body 52*b*. In addition, the gate element 26*b* is turned as a result of the spring force of the further spring element 108*b*, and the tensioning element 16*b* is moved translationally in the guide recess 84*b* by means of the tensioning-element guide gate 110*b*. As a result, a guide unit 42*b* of the power-tool parting device 12*b* is moved relative to the drive element 62*b*. This results in tensioning of a cutting strand 40*b* of the power-tool parting device 12*b* by the spring force of the spring element 28*b* and of the further spring element 108*b*, or by the movement of the tensioning element 16*b*. Thus, automatic tensioning of the cutting strand 40*b* is effected as a result of the power-tool parting device 12*b* being clamped in the receiving recess 78*b* of the main body 52*b*. The tensioning-element guide gate 110*b* in this case is realized in such a manner that, by means of the tensioning-element guide gate 110*b* acting in combination with the spring element 28*b* and the further spring element 108*b*, a movement of the tensioning element 16*b* into a guide-unit insertion position is effected in a self-locking manner. Moreover, the further spring element 108*b* acts, via the gate element 26*b*, upon the clamping element 98*b*, which, in turn, acts upon the operating element 18*b*. As a result, the spring force of the further spring element 108*b* forces the clamping element 98*b* into the clamping position. It is also conceivable, however, for the clamping element 98*b*, or the operating element 18*b*, to be mounted in isolation from the spring force, and to be held in the clamping position by means of a fixing unit of the tool coupling device 10*b*.

Figure 10:
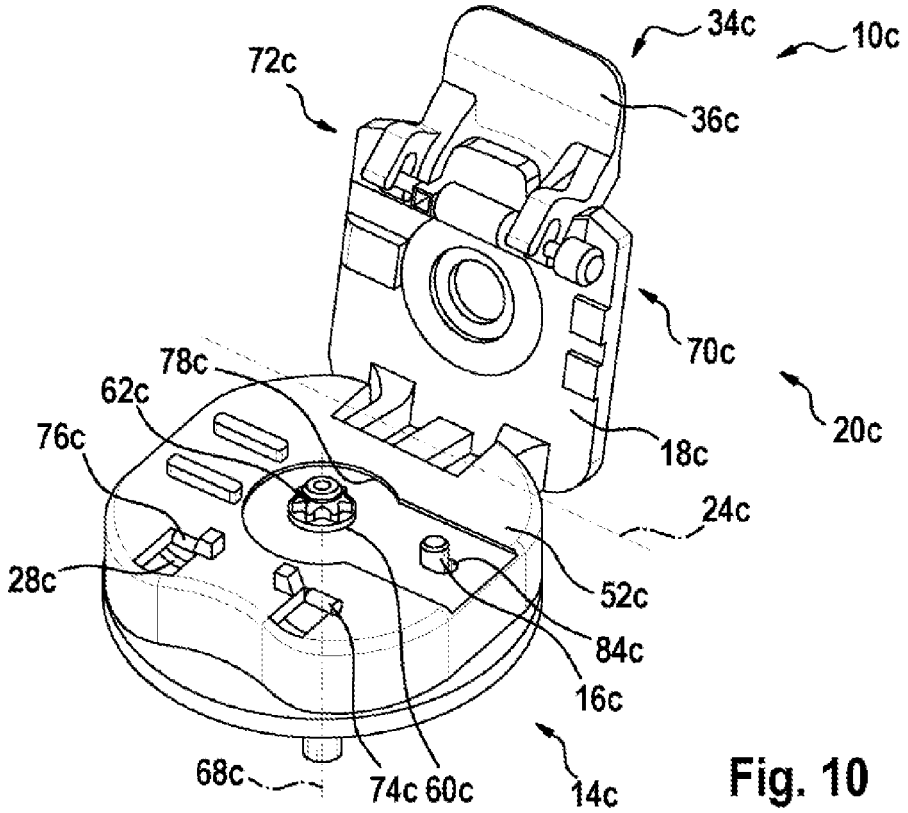

FIG. 10 shows a further, alternative tool coupling device 10*c*, which is provided to receive a power-tool parting device 12*c* realized as a closed system (FIG. 12), demounted from a portable power tool (not represented in greater detail here). The portable power tool is of a design similar to that of the portable power tool 38*a* described in FIGS. 1 to 6. The portable power tool and the power-tool parting device 12*c* together form a power tool system. The tool coupling device 10*c* has at least one cutting-strand tensioning unit 14*c*, which comprises at least one tensioning element 16*c*, and at least one operating unit 20*c* that comprises at least one operating element 18*c*. The operating element 18*c* is mounted such that it can be swiveled about an axis of motion 24*c* of the operating element 18*c* that is at least substantially parallel to a plane of main extent of the operating element 18*c*, or about one that is at least substantially perpendicular to a rotation axis 68*c* of a drive element 62*c* of the tool coupling device 10*c*.

Figure 11:
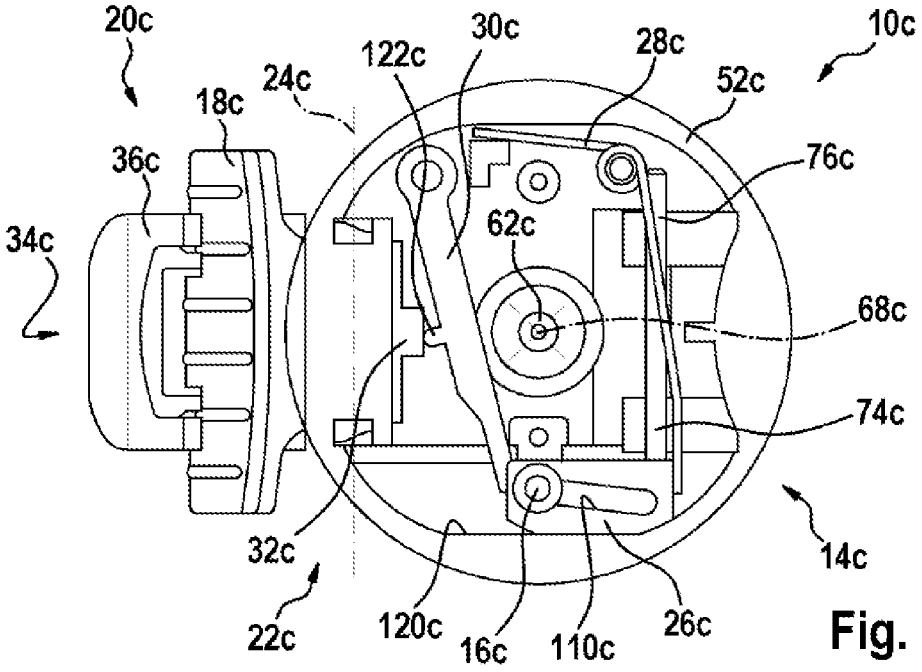

The cutting-strand tensioning unit 14*c* additionally comprises at least one transmission unit 22*c*, which is provided to move the tensioning element 16*c* as a result of an actuation of the operating element 18*c* of the operating unit 20*c*. The transmission unit 22*c* has at least one gate element 26*c* for moving the tensioning element 16*c* as a result of an actuation of the operating element 18*c*. The gate element 26*c* is mounted in a translationally movable manner. The gate element 26*c* in this case is guided in an axial bearing recess 120*c* of a main body 52*c* of the tool coupling device 10*c* (FIG. 11). The gate element 26*c* comprises a tensioning-element guide gate 110*c* for moving the tensioning element 16*c*. The tensioning-element guide gate 110*c* extends at least substantially transversely in relation to an axis of motion of the gate element 26*c*. The tensioning-element guide gate 110*c* is thus sloped relative to the axis of motion of the gate element 26*c*.

Figure 12:
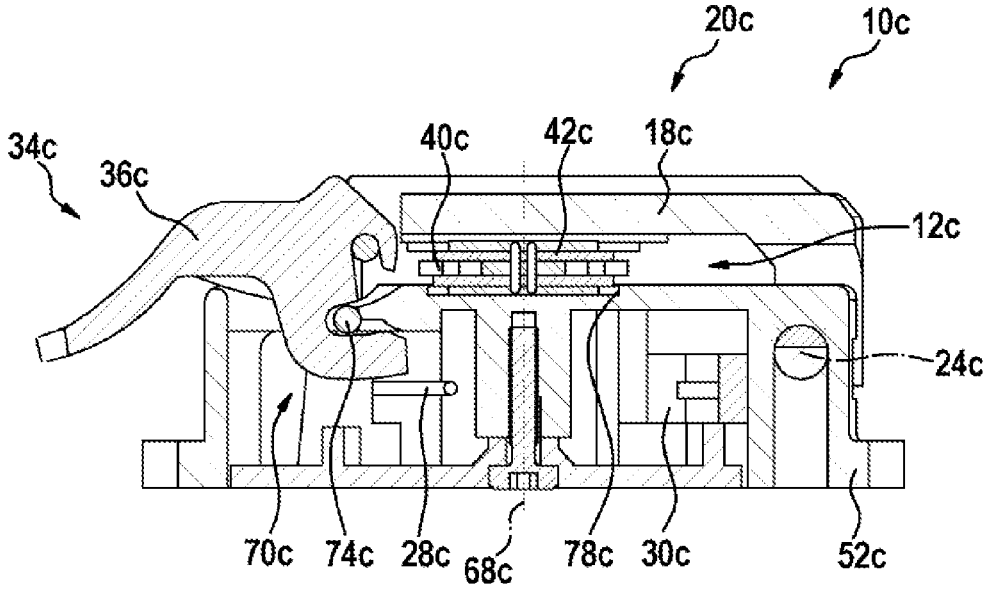

Moreover, the transmission unit 22*c* comprises at least one lever element 30*c* that, as a result of an actuation of the operating element 18*c*, moves the gate element 26*c* of the transmission unit 22*c* for the purpose of moving the tensioning element 16*c*. The lever element 30*c* is mounted in the main body 52*c* so as to be rotatable about an axis of motion of the lever element 30*c* that is at least substantially parallel to the rotation axis 68*c* of the drive element 62*c*. For the purpose of moving the gate element 26*c*, the lever element 30*c* bears with one end against the gate element 26*c*. In addition, the lever element 30*c* has an actuating extension 122*c*, which acts in combination with the operating element 18*c*. Furthermore, the cutting-strand tensioning unit 14*c* comprises at least one spring element 28*c*, which is provided to apply a spring force to the tensioning element 16*c* and/or to the gate element 26*c* of the transmission unit 22*c*. The spring element 28*c* is realized as a leg spring. The spring element 28*c* in this case is supported with one end on the main body 52*c* and, with another end, the spring element 28*c* is supported on the gate element 26*c*. The tool coupling device 10*c* additionally has at least one fixing unit 34*c*, comprising at least one fixing element 36*c* provided to fix the operating element 18*c* in at least one position. The fixing unit 34*c* is of a design similar to that of the fixing unit 34*a* described in FIGS. 1 to 6. The fixing element 36*c* thus fixes the operating element 18*c* in a tool fixing position of the operating element 18*c* (FIG. 12).

For the purpose of coupling the power-tool parting device 12*c* to the tool coupling device 10*c*, the power-tool parting device 12*c* is inserted in a receiving recess 78*c* of the main body 52*c*, along a direction that is at least substantially parallel to the rotation axis 68*c* of the drive element 62*c*. The operating element 18*c* in this case is disposed in the position in which it has been swiveled away from the main body 52*c*. As the power-tool parting device 12*c* is inserted in the receiving recess 78*c*, the drive element 62*c* is introduced into a coupling recess 94*c* of a guide unit 42*c* of the power-tool parting device 12*c*. As a result, a cutting strand 40*c* of the power-tool parting device 12*c* engages with the drive element 62*c*. In addition, the tensioning element 16*c* is introduced into a tensioning recess 86*c* of the guide unit 42*c*. As a result of the operating element 18*c* being moved into the tool fixing position, the operating element 18*c* actuates the lever element 30*c* by means of an eccentric element 32*c* of the transmission unit 22*c*. As a result, the lever element 30*c* is swiveled about the axis of motion of the lever element 30*c*, and actuates the gate element 26*c*. The gate element 26*c* in this case is moved translationally. The tensioning element 16*c* is thus moved into a guide-unit insertion position by the tensioning-element guide gate 110*c*. In respect of further features of the tool coupling device 10*c*, reference may be made to the description of FIGS. 1 to 6.

Figure 13:
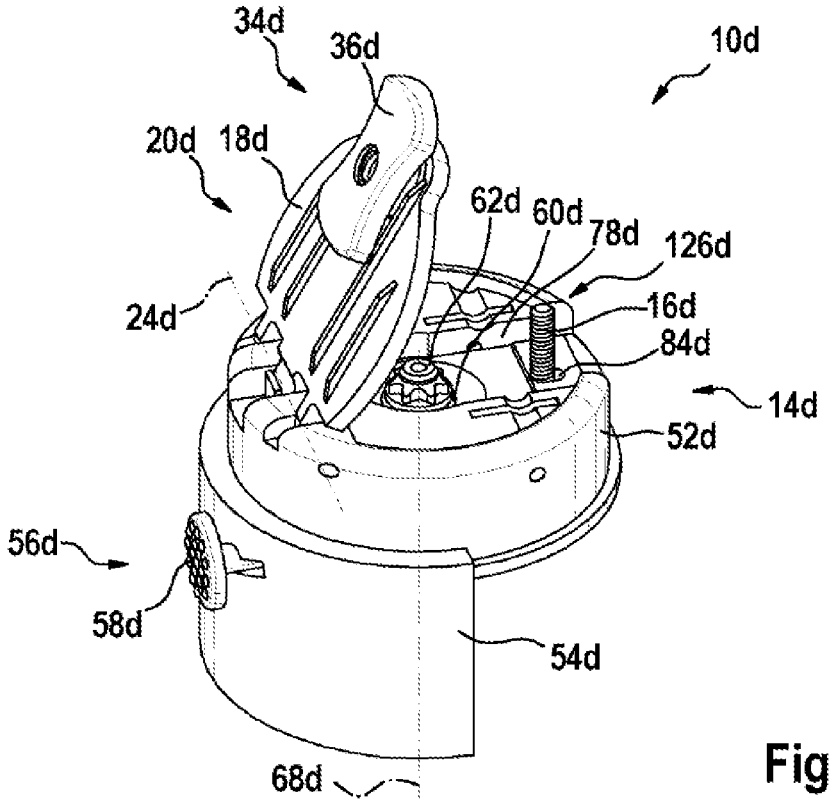

FIG. 13 shows a further, alternative tool coupling device 10*d*, which is provided to receive a power-tool parting device 12*d* realized as a closed system (FIG. 14), demounted from a portable power tool (not represented in greater detail here). The portable power tool is of a design similar to that of the portable power tool 38*a* described in FIGS. 1 to 6. The portable power tool and the power-tool parting device 12*d* together form a power tool system. The tool coupling device 10*d* has at least one cutting-strand tensioning unit 14*d*, which comprises at least one tensioning element 16*d*, and at least one operating unit 20*d* that comprises at least one operating element 18*d*. The operating element 18*d* is mounted such that it can be swiveled about an axis of motion 24*d* of the operating element 18*d* that is at least substantially parallel to a plane of main extent of the operating element 18*d*, or about one that is at least substantially perpendicular to a rotation axis 68*d* of a drive element 62*d* of the tool coupling device 10*d*.

Figure 14:
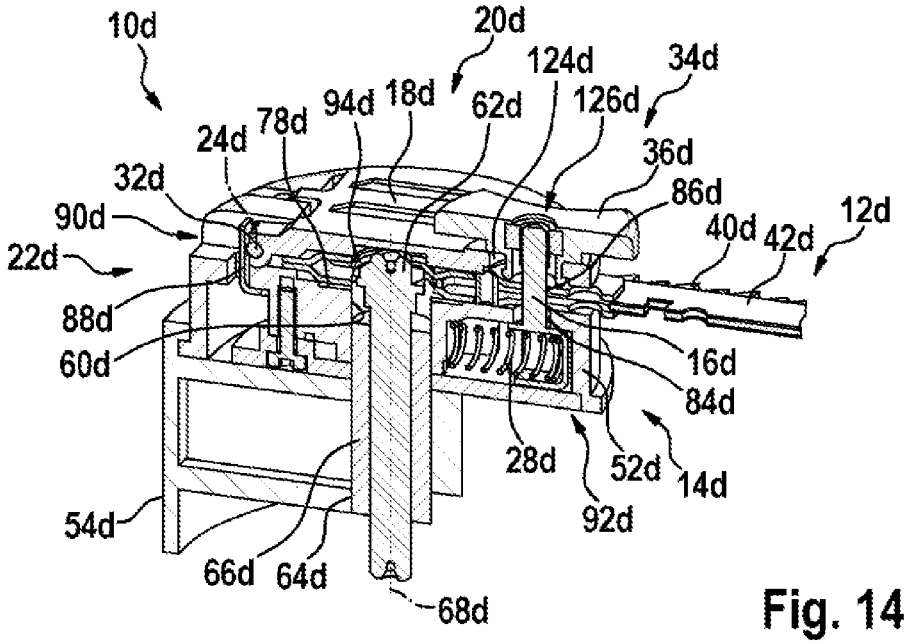

The cutting-strand tensioning unit 14*d* comprises at least one transmission unit 22*d*, which is provided to move the tensioning element 16*d* as a result of an actuation of the operating element 18*d* of the operating unit 20*d*. The transmission unit 22*d* is of a design similar to that of the transmission unit 22*a* described in FIGS. 1 to 6. Furthermore, the tool coupling device 10*d* has at least one fixing unit 34*d*, comprising at least one fixing element 36*d* provided to fix the operating element 18*d* in at least one position. The fixing element 36*d* in this case is realized as a wing nut. Moreover, the fixing element 36*d* is mounted in a rotationally and translationally movable manner in a fixing recess 124*d* of the operating element 18*d* (FIG. 14). For the purpose of fixing the operating element 18*d*, the fixing element 36*d* acts in combination with a threaded region 126*d* of the tensioning element 16*d*. When the operating element 18*d* is moved into a tool fixing position of the operating element 18*d*, the fixing element 36*d* and the threaded region 126*d* of the tensioning element 16*d* are connected to each other. Since the fixing element 36*d* is disposed in the fixing recess 124*d*, the tensioning element 16*d* can move translationally together with the fixing element 36*d*. In respect of further features of the tool coupling device 10*d*, reference may be made to the description of FIGS. 1 to 6.

Figure 15:
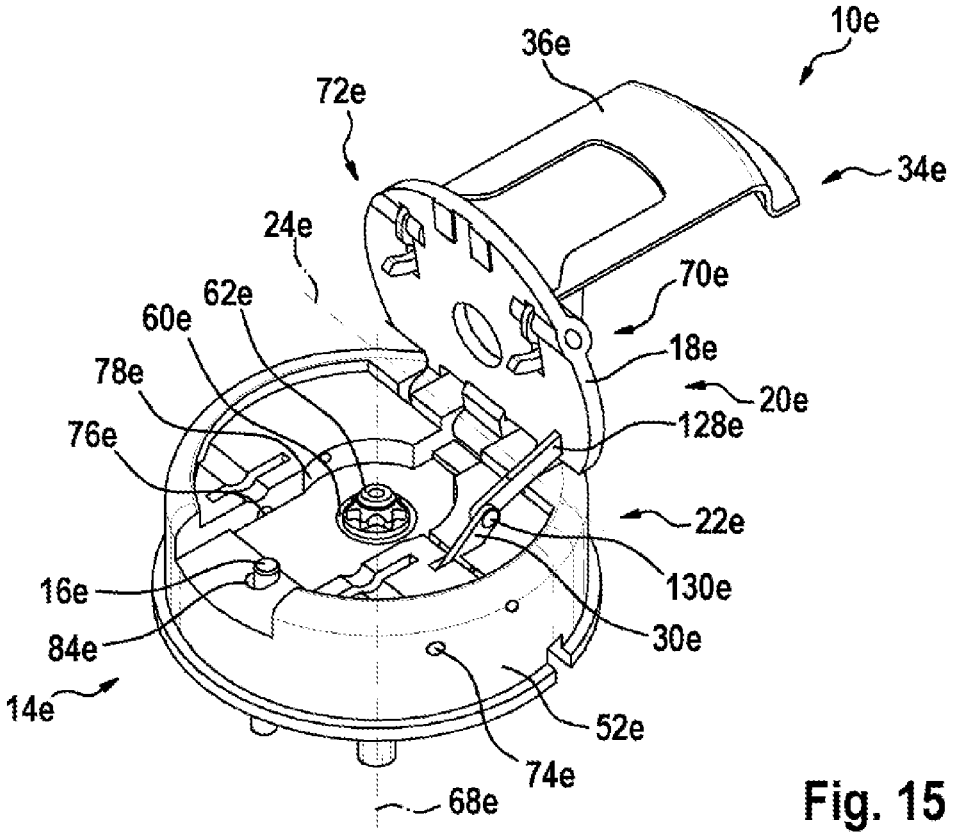
Figure 16:
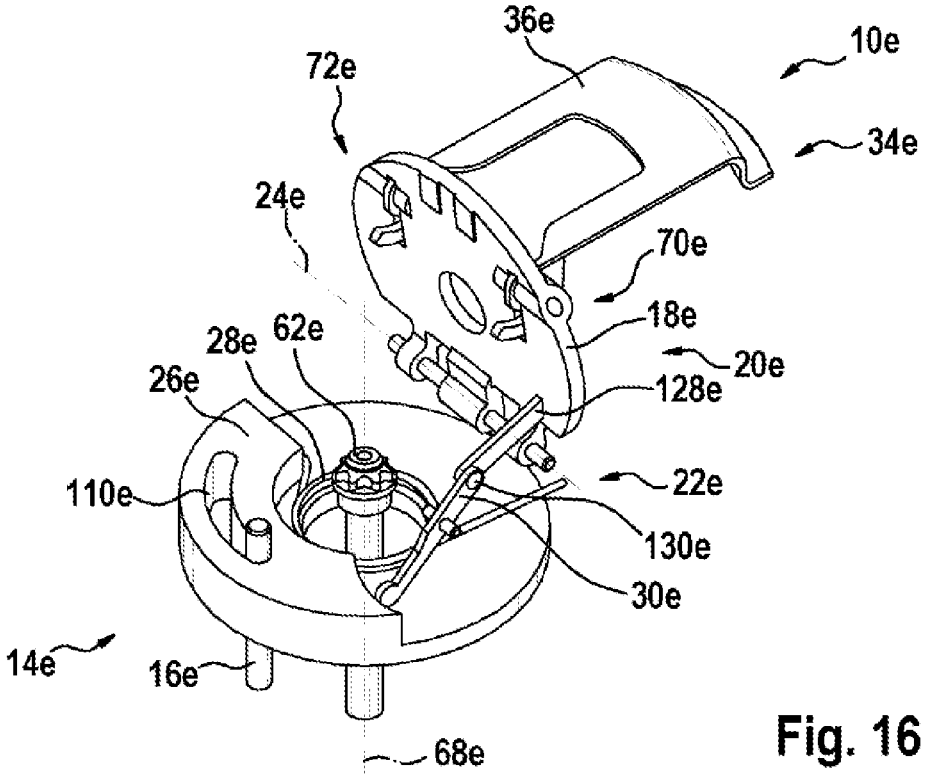

FIG. 15 shows a further, alternative tool coupling device 10*e*, which is provided to receive a power-tool parting device realized as a closed system (not represented in greater detail here), demounted from a portable power tool (not represented in greater detail here). The portable power tool is of a design similar to that of the portable power tool 38*a* described in FIGS. 1 to 6. The portable power tool and the power-tool parting device together form a power tool system. The tool coupling device 10*e* has at least one cutting-strand tensioning unit 14*e*, which comprises at least one tensioning element 16*e*, and at least one operating unit 20*e* that comprises at least one operating element 18*e*. The operating element 18*e* is mounted such that it can be swiveled about an axis of motion 24*e* of the operating element 18*e* that is at least substantially parallel to a plane of main extent of the operating element 18*e*, or about one that is at least substantially perpendicular to a rotation axis 68*e* of a drive element 62*e* of the tool coupling device 10*e*.

The cutting-strand tensioning unit 14*e* additionally comprises at least one transmission unit 22*e*, which is provided to move the tensioning element 16*e* as a result of an actuation of the operating element 18*e* of the operating unit 20*e*. The transmission unit 22*e* has at least one gate element 26*e* for moving the tensioning element 16*e* as a result of an actuation of the operating element 18*e*. The gate element 26*e* is mounted in a rotatable manner. The gate element 26*e* in this case is mounted in a rotatable manner in a main body 52*e* of the tool coupling device 10*e*. The gate element 26*e* additionally has at least one tensioning-element guide gate 110*e* for moving the tensioning element 16*e* as a result of an actuation of the operating element 18*e*. The transmission unit 22*e* additionally comprises at least one lever element 30*e* that, as a result of an actuation of the operating element 18*e*, moves the gate element 26*e* of the transmission unit 22*e* for the purpose of moving the tensioning element 16*e*. The lever element 30*e* in this case is mounted in the main body 52*e* such that it can be swiveled about an axis of motion of the lever element 30*e*. The axis of motion of the lever element 30*e* in this case is at least substantially parallel to the axis of motion 24*e* of the operating element 18*e*. Moreover, the transmission unit 22*e* has a force transfer element 128*e*, which is mounted in a swiveling manner on the operating element 18*e*. In addition, the force transfer element 128*e* is connected in a swiveling manner to the lever element 30*e*, by means of a link element 130*e*. The link element 130*e* in this case is realized as a hinge pin, which engages in a link eye of the lever element 30*e* and of the force transfer element 128*e*, respectively.

Furthermore, the cutting-strand tensioning unit 14*e* comprises at least one spring element 28*e*, which is provided to apply a spring force to the tensioning element 16*e* and/or to the gate element 26*e* of the transmission unit 22*e*. The spring element 28*e* is realized as a leg spring. The spring element 28*e* in this case is supported with one end on the main body 52*e* and, with another end, the spring element 28*e* is supported on the gate element 26*e*. As a result of the operating element 18*e* moving into a tool fixing position of the operating element 18*e*, in the direction of the main body 52*e*, the lever element 30*e* is actuated by means of the force transfer element 128*e*. As a result, the lever element 30*e* releases the gate element 26*e*. The gate element 26*e* is moved by the spring force of the spring element 28*e*. As a result, the tensioning element 16*e* is moved into a tensioning position of the tensioning element 16*e* by means of the tensioning-element guide gate 110*e*. In respect of further features of the tool coupling device 10*e*, reference may be made to the description of FIGS. 1 to 6.

Figure 17:
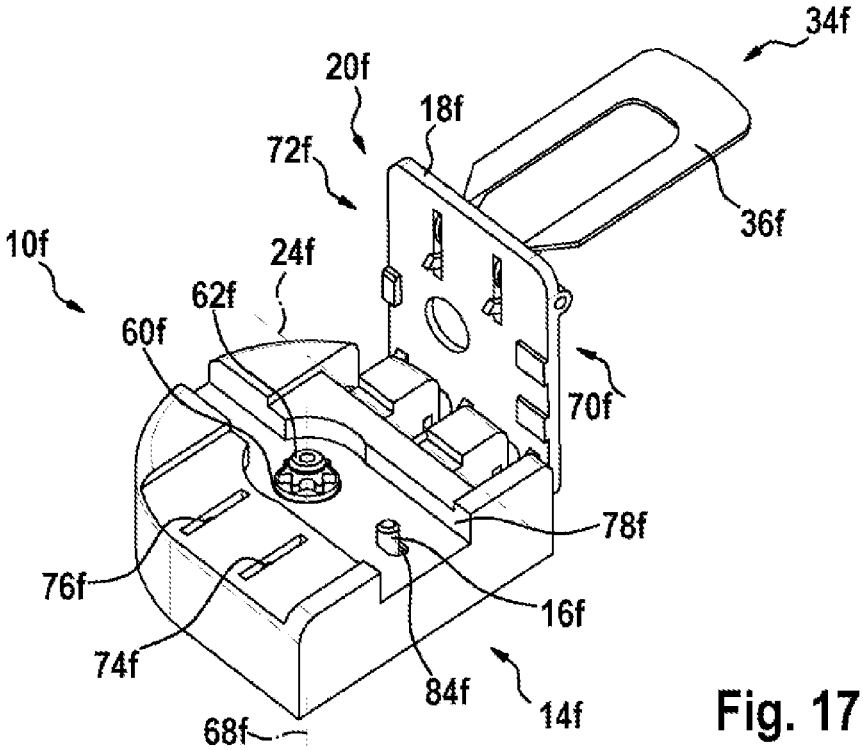

FIG. 17 shows a further, alternative tool coupling device 10*f*, which is provided to receive a power-tool parting device 12*f* realized as a closed system (FIG. 18), demounted from a portable power tool (not represented in greater detail here). The portable power tool is of a design similar to that of the portable power tool 38*a* described in FIGS. 1 to 6. The portable power tool and the power-tool parting device 12*f* together form a power tool system. The tool coupling device 10*f* has at least one cutting-strand tensioning unit 14*f*, which comprises at least one tensioning element 16*f*, and at least one operating unit 20*f* that comprises at least one operating element 18*f*. The operating element 18*f* is mounted such that it can be swiveled about an axis of motion 24*f* of the operating element 18*f* that is at least substantially parallel to a plane of main extent of the operating element 18*f*, or about one that is at least substantially perpendicular to a rotation axis 68*f* of a drive element 62*f* of the tool coupling device 10*f*.

Figure 18:
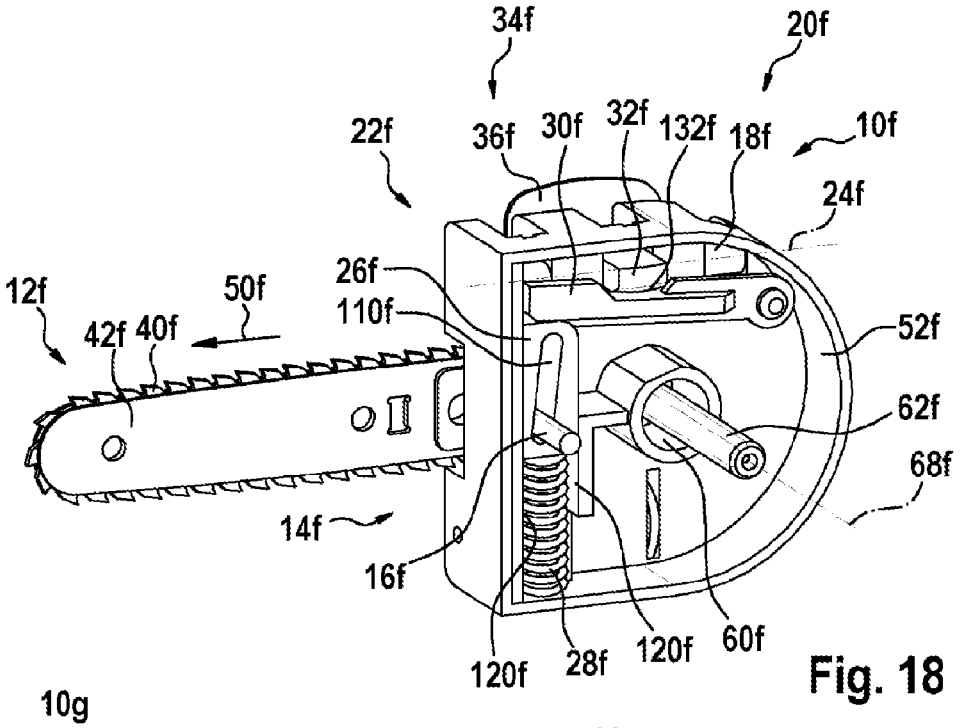

The cutting-strand tensioning unit 14*f* additionally comprises at least one transmission unit 22*f*, which is provided to move the tensioning element 16*f* as a result of an actuation of the operating element 18*f* of the operating unit 20*f*. The transmission unit 22*f* has at least one gate element 26*f* for moving the tensioning element 16*f* as a result of an actuation of the operating element 18*f*. The gate element 26*f* is mounted in a translationally movable manner. In this case, the gate element 26*f* is guided in an axial bearing recess 120*f* of a main body 52*f* of the tool coupling device 10*f* (FIG. 18). The gate element 26*f* comprises a tensioning-element guide gate 110*f*, for moving the tensioning element 16*f*. The tensioning-element guide gate 110*f* extends at least substantially transversely in relation to an axis of motion of the gate element 26*f*. The tensioning-element guide gate 110*f* is thus sloped relative to the axis of motion of the gate element 26*f*.

The transmission unit 22*f* additionally comprises at least one lever element 30*f* that, as a result of an actuation of the operating element 18*f*, moves the gate element 26*f* of the transmission unit 22*f* for the purpose of moving the tensioning element 16*f*. The lever element 30*f* is mounted in the main body 52*f* so as to be rotatable about an axis of motion of the lever element 30*f* that is at least substantially parallel to the rotation axis 68*f* of the drive element 62*f*. For the purpose of moving the gate element 26*f*, the lever element 30*f* bears with one end against the gate element 26*f*. In addition, the lever element 30*f* has an operating-element pressure region 132*f*, which acts in combination with the operating element 18*f*. Furthermore, the cutting-strand tensioning unit 14*f* comprises at least one spring element 28*f*, which is provided to apply a spring force to the clamping element 16*f* and/or to the gate element 26*f* of the transmission unit 22*f*. The spring element 28*f* is realized as a helical compression spring. The spring element 28*f* in this case is supported with one end on the main body 52*f* and, with another end, the spring element 28*f* is supported on the gate element 26*f*. The spring element 28*f* is disposed in the axial bearing recess 120*f* of the main body 52*f*. In respect of further features of the tool coupling device 10*f*, reference may be made to the description of FIGS. 1 to 6.

Figure 19:
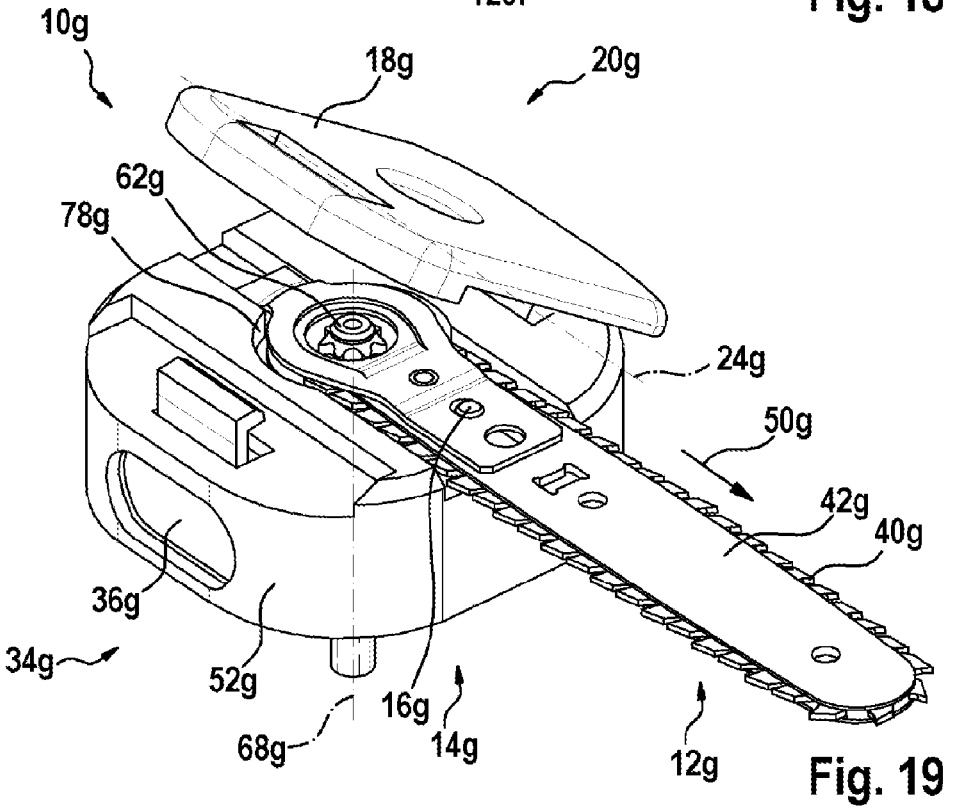
Figure 20:
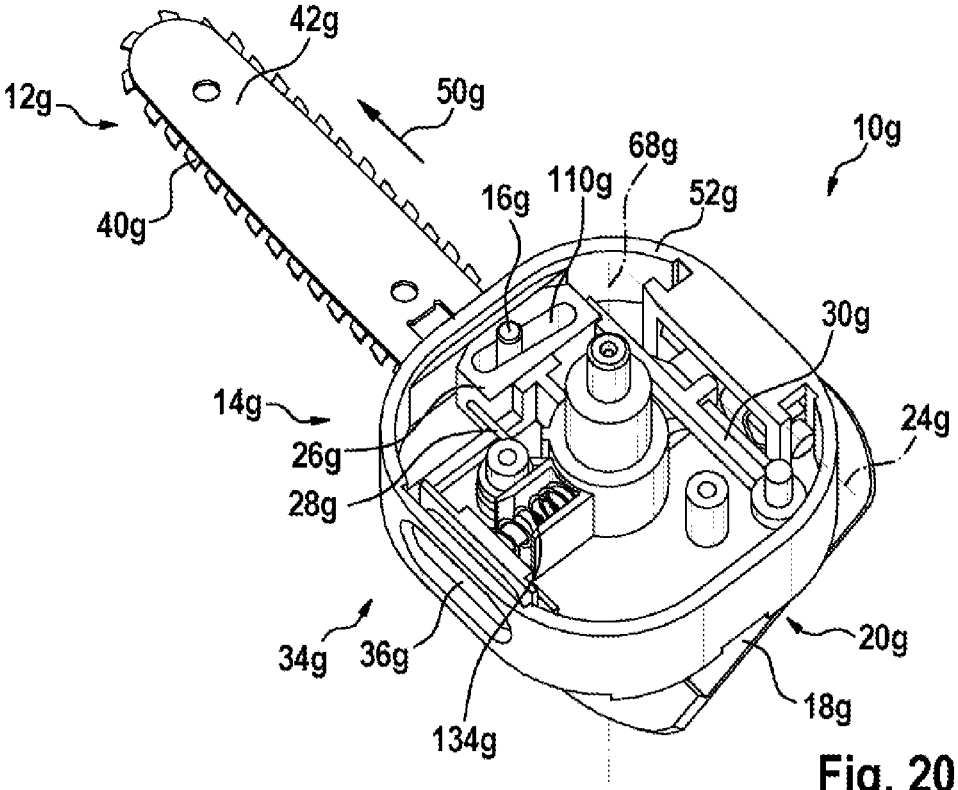
Figure 21:
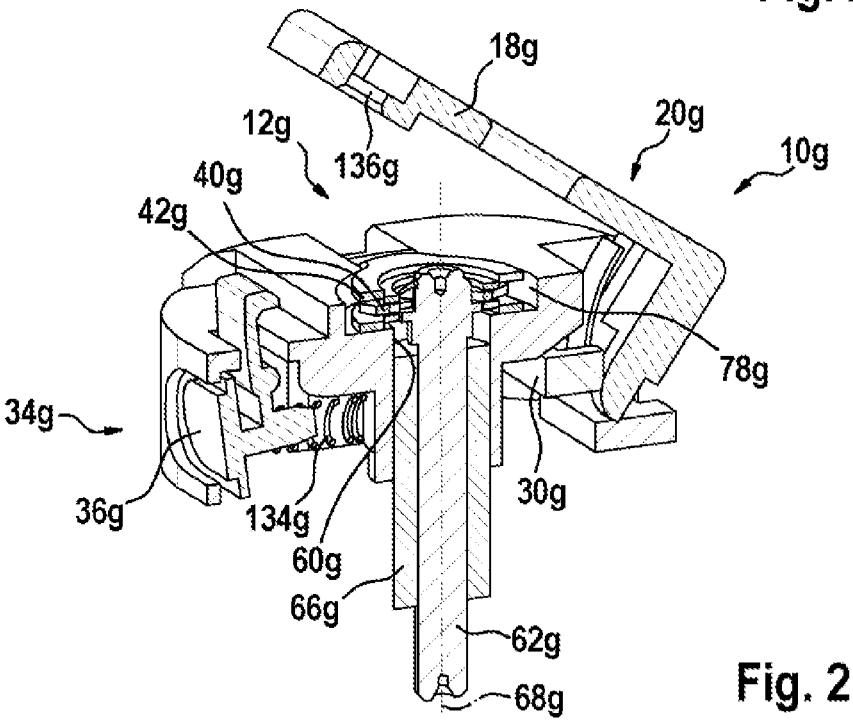

FIG. 19 shows a further, alternative tool coupling device 10*g*, which is provided to receive a power-tool parting device 12*g* realized as a closed system, demounted from a portable power tool (not represented in greater detail here). The portable power tool is of a design similar to that of the portable power tool 38*a* described in FIGS. 1 to 6. The portable power tool and the power-tool parting device 12*g* together form a power tool system. The design of the tool coupling device 10*g* is at least substantially similar to that of the tool coupling device 10*f* described in FIGS. 17 and 18. Unlike the tool coupling device 10*f*, a cutting-strand tensioning unit 14*g* of the tool coupling device 10*g* has a spring element 28*g* realized as a leg spring. In addition, the tool coupling device 10*g* has at least one fixing unit 34*g*, comprising at least one fixing element 36*g* provided to fix the operating element 18*g* in at least one position. The fixing element 36*g* is mounted in a swiveling manner in a main body 52$g$ of the tool coupling device 10$g$ (FIG. 21). The fixing unit 34$g$ additionally has a fixing spring element 134$g$, which is provided to apply a spring force to the fixing element 36$g$ (FIGS. 20 and 21). The fixing element 36$g$ is thus realized as a spring-biased latching hook, which acts in combination with a fixing extension 136$g$ disposed in the operating element 18$g$, for the purpose of fixing the operating element 18$g$ in a tool fixing position (FIG. 21). The fixing extension 136$g$ in this case is realized so as to be integral with the operating element 18$g$.

FIGS. 22 to 31 show alternative holding units of a tool coupling device, which are provided to apply a clamping force in the direction of a main body of the tool coupling device. Components, features and functions that remain substantially the same are denoted basically by the same references. To differentiate the exemplary embodiments, superscript numerals have been appended, in addition to the letters, to the references of the exemplary embodiments. The following description is limited substantially to the differences as compared with the first exemplary embodiment in FIGS. 1 to 6, and reference may be made to the description of the first exemplary embodiment in FIGS. 1 to 6 in respect of components, features and functions that remain the same.

Figure 22:
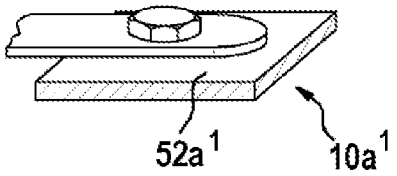

FIG. 22 shows a holding unit of a tool coupling device 10$a^1$. The holding unit has at least one screw connection element, which acts in combination with a threaded recess (not represented in greater detail here) disposed on the main body 52$a^1$, for the purpose of generating a clamping force, or holding force, in the direction of a main body 52$a^1$ of the tool coupling device 10$a^1$.

Figure 23:
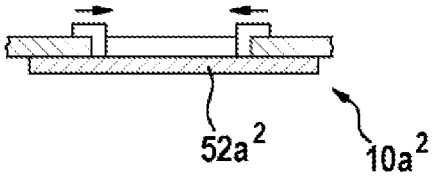

FIG. 23 shows a holding unit of a tool coupling device 10$a^2$. The holding unit has at least two hook elements, aligned in opposing directions, which can be inserted in recesses of a power-tool parting device 12$a^2$ for the purpose of generating a clamping force, or holding force, in the direction of a main body 52$a^1$ of the tool coupling device 10$a^1$ and which, following insertion, are moved in opposing directions as a result of a spring force.

Figure 24:
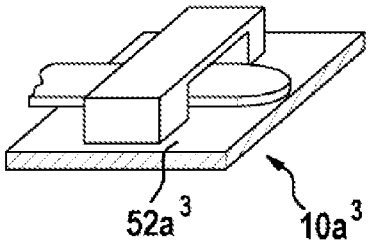

FIG. 24 shows a holding unit of a tool coupling device 10$a^3$. The holding unit has at least one stirrup element, which delimits a recess into which a power-tool parting device 12$a^3$ can be introduced, at least substantially perpendicularly in relation to an active holding force.

Figure 25:
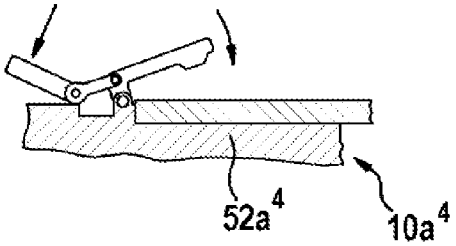

FIG. 25 shows an alternative holding unit of a tool coupling device 10$a^4$. The holding unit has at least one toggle mechanism unit, which is provided to generate a clamping force, or holding force, in the direction of a main body 52$a^4$ of the tool coupling device 10$a^4$.

Figure 26:
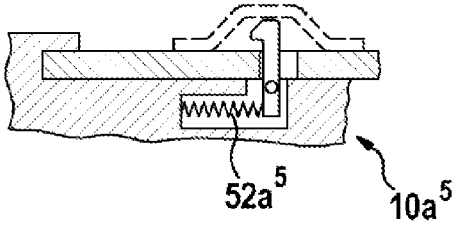

FIG. 26 shows an alternative holding unit of a tool coupling device 10$a^5$. The holding unit has at least one spring-loaded latching hook, which acts in combination with a recess of a power-tool parting device 12$a^5$, for the purpose of generating a clamping force, or holding force, in the direction of a main body 52$a^5$ of the tool coupling device 10$a^5$.

Figure 27:
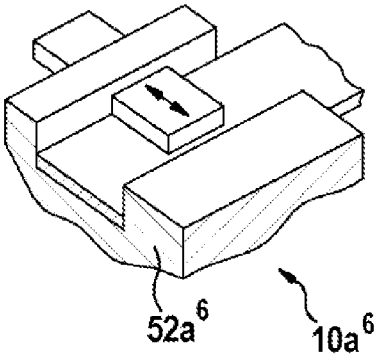

FIG. 27 shows an alternative holding unit of a tool coupling device 10$a^6$. The holding unit has at least one transverse slide element that, after a power-tool parting device 12$a^6$ has been inserted in a receiving recess 78$a^6$ of a main body 52$a^6$ of the tool coupling device 10$a^6$, is mounted so as to be displaceable over the power-tool parting device 12$a^6$, at least substantially transversely in relation to an insertion direction of the power-tool parting device 12$a^6$.

Figure 28:
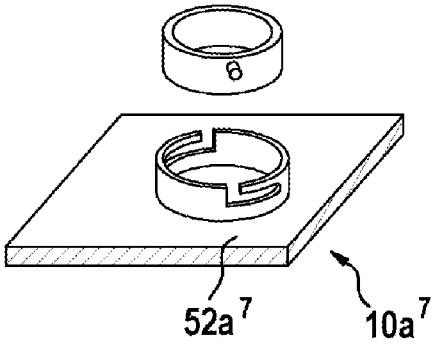

FIG. 28 shows an alternative holding unit of a tool coupling device 10$a^7$. The holding unit has at least one bayonet locking element, which acts in combination with a bayonet locking element of a power-tool parting device 12$a^7$, for the purpose of generating a clamping force, or holding force, in the direction of a main body 52$a^7$ of the tool coupling device 10$a^7$.

Figure 29:
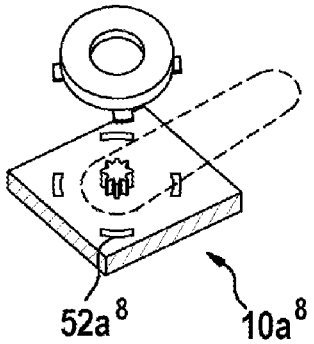

FIG. 29 shows an alternative holding unit of a tool coupling device 10$a^8$. The holding unit has at least one holding axle, which acts in combination with a holding-lug engagement-extension cover element of the holding unit at least one, for the purpose of generating a clamping force, or holding force, in the direction of a main body 52$a^8$ of the tool coupling device 10$a^8$.

Figure 30:
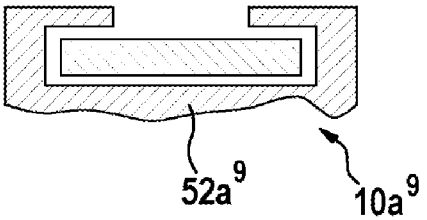

FIG. 30 shows an alternative holding unit of a tool coupling device 10$a^9$. The holding unit has at least one C-shaped form-closure holding element, which can be inserted in a power-tool parting device 12$a^9$.

Figure 31:
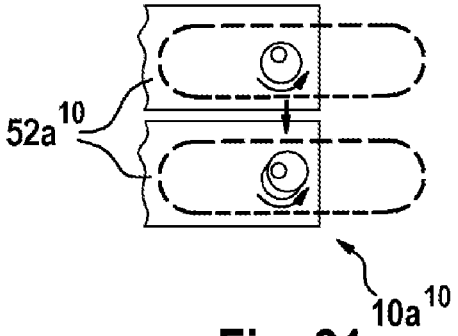

FIG. 31 shows an alternative holding unit of a tool coupling device 10$a^{10}$. The holding unit has at least one eccentric element, which acts in combination with a circular recess of a power-tool parting device 12$a^{10}$, for the purpose of generating a clamping force, or holding force, in the direction of a main body 52$a^{10}$ of the tool coupling device 10$a^{10}$.

FIGS. 32 to 35 show alternative power-tool parting-device torque holding units of a tool coupling device, which are provided to secure the power-tool parting device against a rotational movement when the power-tool parting device is coupled to the tool coupling device. Components, features and functions that remain substantially the same are denoted basically by the same references. To differentiate the exemplary embodiments, superscript numerals have been appended, in addition to the letters, to the references of the exemplary embodiments. The following description is limited substantially to the differences as compared with the first exemplary embodiment in FIGS. 1 to 6, and reference may be made to the description of the first exemplary embodiment in FIGS. 1 to 6 in respect of components, features and functions that remain the same.

Figure 32:
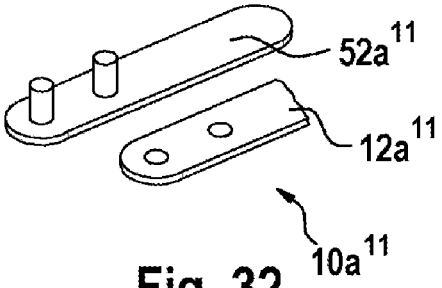

FIG. 32 shows an alternative power-tool parting-device torque holding unit of a tool coupling device 10$a^{11}$. The power-tool parting-device torque holding unit has at least two stud-type torque holding elements, which can be inserted in corresponding recesses of a power-tool parting device 12$a^{11}$. It is also conceivable, however, for the power-tool parting-device torque holding unit to have at least two recesses, in each of which a respective stud-type torque holding element of the power-tool parting device 12$a^{11}$ can be inserted.

Figure 33:
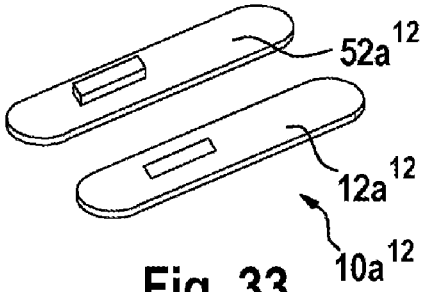

FIG. 33 shows an alternative power-tool parting-device torque holding unit of a tool coupling device 10$a^{12}$. The power-tool parting-device torque holding unit has at least one rectangular torque holding extension, which can be inserted in at least one rectangular recess of a power-tool parting device 12$a^{12}$. It is also conceivable, however, for the power-tool parting-device torque holding unit to have at least one rectangular recess, in which the rectangular torque holding element of the power-tool parting device 12$a^{12}$ can be inserted.

Figure 34:
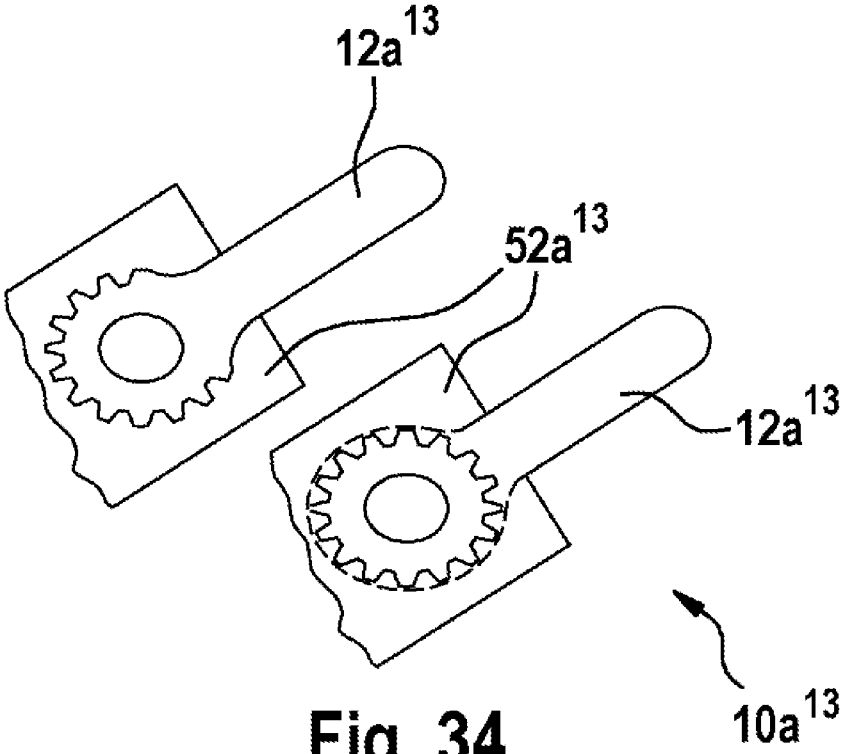

FIG. 34 shows an alternative power-tool parting-device torque holding unit of a tool coupling device 10$a^{13}$. The power-tool parting-device torque holding unit has at least one tooth system (external tooth system, internal tooth system or end-face tooth system), which acts in combination with a corresponding tooth system of a power-tool parting device 12$a^{13}$.

Figure 35:
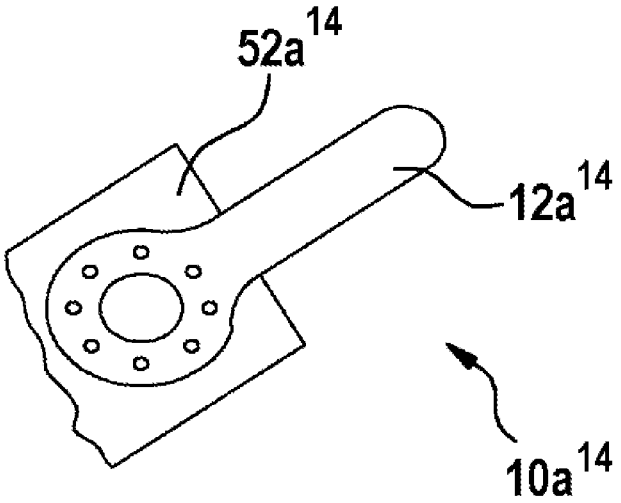

FIG. 35 shows an alternative power-tool parting-device torque holding unit of a tool coupling device 10$a^{14}$. The power-tool parting-device torque holding unit has at least a multiplicity of form-closure elements, disposed symmetrically around a rotation axis 68$a^{14}$ of a drive element 62$a^{14}$, which act in combination with symmetrically disposed form-closure elements of a power-tool parting device 12$a^{14}$.

The invention claimed is:

1. A power tool system, comprising:

at least one portable power tool including a housing and a tool coupling device mounted on the housing, the tool coupling device including:

at least one cutting-strand tensioning unit comprising a main body fixedly mounted to the housing and at least one tensioning element extending through a guide recess of the main body; and at least one operating unit pivotally connected to the main body and including at least one operating element, wherein the tensioning element is mounted in a translationally movable manner relative to the main body and the guide recess, wherein the cutting-strand tensioning unit comprises at least one transmission unit operatively connected to the at least one operating unit and the tensioning element and configured to move the tensioning element relative to the guide recess as a result of an actuation of the operating element of the operating unit; and at least one power-tool parting device having at least one cutting strand and at least one guide unit that, together with the cutting strand, forms a closed system, wherein actuation of the operating element includes pivoting of the at least one operating element relative to the main body.

2. The power tool system as claimed in claim 1, further comprising:

a drive element configured to drive the at least one cutting strand relative to the at least one guide unit; and a carrier element of the tool coupling element supported by the main body and including an actuating region operatively connected to the at least one operating element, the carrier element defining an opening through which the drive element extends, and the tensioning element extending directly from the carrier element.

3. A portable power tool, comprising:

a housing; and a tool coupling device mounted on the housing and including:

at least one cutting-strand tensioning unit comprising a main body fixedly mounted to the housing and at least one tensioning element extending through a guide recess of the main body; and at least one operating unit pivotally connected to the main body and including at least one operating element, wherein the tensioning element is mounted in a translationally movable manner relative to the main body and the guide recess, wherein the cutting-strand tensioning unit comprises at least one transmission unit operatively connected to the at least one operating unit and the tensioning element and configured to move the tensioning element relative to the guide recess as a result of an actuation of the at least one operating element of the operating unit, and wherein actuation of the operating element includes pivoting of the at least one operating element relative to the main body.

4. A tool coupling device for receiving a power-tool parting device realized as a closed system, comprising:

at least one cutting-strand tensioning unit comprising a main body and at least one tensioning element extending through a guide recess of the main body; and at least one operating unit pivotally connected to the main body and including at least one operating element, wherein the tensioning element is mounted in a translationally movable manner relative to the main body and the guide recess, wherein the cutting-strand tensioning unit comprises at least one transmission unit operatively connected to the at least one operating unit and the tensioning element and configured to move the tensioning element relative to the guide recess as a result of an actuation of the at least one operating element of the operating unit, and wherein actuation of the operating element includes pivoting of the at least one operating element relative to the main body.

5. The tool coupling device as claimed in claim 4, wherein the operating element is mounted such that the operating element is configured to be swiveled about an axis of motion of the operating element that is at least substantially parallel to a plane of main extent of the operating element.

6. The tool coupling device as claimed at least in claim 4, wherein the operating element is mounted such that the operating element is configured to rotate about an axis of motion of the operating element that is at least substantially perpendicular to a plane of main extent of the operating element.

7. The tool coupling device as claimed in claim 4, wherein the transmission unit has at least one gate element configured to move the tensioning element relative to the guide recess as a result of an actuation of the operating element.

8. The tool coupling device at least as claimed in claim 7, wherein the gate element is mounted in a rotatable manner.

9. The tool coupling device as claimed in claim 7, wherein the gate element is mounted in a translationally movable manner relative to the main body.

10. The tool coupling device as claimed in claim 9, wherein the cutting-strand tensioning unit has at least one spring element, that is configured to apply a spring force to the at least one tensioning element and the gate element of the transmission unit.

11. The tool coupling device as claimed in claim 10, wherein the transmission unit comprises at least one lever element that, as a result of an actuation of the operating element, moves the gate element of the transmission unit to move the tensioning element.

12. The tool coupling device as claimed in claim 11, further comprising at least one fixing unit including at least one fixing element configured to fix the operating element in at least one position.

13. The tool coupling device as claimed in claim 12, wherein:

the fixing element is pivotally connected to the at least one operating element, the at least one operating element defines a first axis of motion about the main body, the at least one fixing element defines a second axis of motion about the at least one operating element, and the first axis of motion is parallel to the second axis of motion.

14. The tool coupling device as claimed in claim 4, wherein the transmission unit comprises at least one eccentric element that acts in combination with the tensioning element to move the tensioning element as a result of an actuation of the operating element.

15. The tool coupling device as claimed in claim 4, further comprising:

an eccentric element of the at least one operating element; and a carrier element supported by the main body and including an actuating region at a first distal end portion of the carrier element against which the eccentric element is positioned, wherein the tensioning element extends directly from an opposite second distal end portion of the carrier element, and wherein pivotal movement of the at least one operating element moves the eccentric element relative to the actuating region and causes the eccentric element to slide the carrier element relative to the main body resulting in the translational movement of the tensioning element relative to the main body and the guide recess.

16. The tool coupling device as claimed in claim 15, further comprising:

a spring located in a support region of the carrier element and configured to bias the actuating region of the carrier element against the eccentric element of the at least one operating element.

* * * * *